US007100524B2

(12) United States Patent
Sakakibara et al.

(10) Patent No.: US 7,100,524 B2
(45) Date of Patent: Sep. 5, 2006

(54) SEWING MACHINE AND THREAD CASSETTE ATTACHED THERETO

(75) Inventors: Kaoru Sakakibara, Aichi (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 157 days.

(21) Appl. No.: 10/656,338

(22) Filed: Sep. 8, 2003

(65) Prior Publication Data

US 2004/0173131 A1 Sep. 9, 2004

(30) Foreign Application Priority Data

Sep. 10, 2002 (JP) ..... 2002-264499

(51) Int. Cl.
*D05B 53/00* (2006.01)

(52) U.S. Cl. ..... 112/225; 112/302

(58) Field of Classification Search ..... 112/302, 112/259, 221, 225, 226, 253, 270, 278; 360/129, 360/131, 134; D15/66, 69, 76
See application file for complete search history.

(56) References Cited

U.S. PATENT DOCUMENTS

| | | | | | |
|---|---|---|---|---|---|
| 2,900,941 | A | * | 8/1959 | Platt | 112/270 |
| 3,749,039 | A | | 7/1973 | Fritts | |
| 4,100,867 | A | * | 7/1978 | Bass et al. | 112/270 |
| 4,183,313 | A | * | 1/1980 | Odermann et al. | 112/302 |
| 4,408,242 | A | * | 10/1983 | Nishida et al. | 360/131 |
| 4,468,836 | A | * | 9/1984 | Omata | 16/82 |
| 4,936,234 | A | * | 6/1990 | Jimenez et al. | 112/259 |
| 5,063,866 | A | * | 11/1991 | Jimenez et al. | 112/302 |
| 5,441,003 | A | * | 8/1995 | Hashiride | 112/259 |
| 5,754,362 | A | * | 5/1998 | Konta et al. | 360/96.5 |
| 6,325,264 | B1 | * | 12/2001 | Omosako | 226/91 |
| 6,467,419 | B1 | * | 10/2002 | Hori | 112/302 |
| 6,729,252 | B1 | * | 5/2004 | Wada et al. | 112/278 |
| 6,814,014 | B1 | * | 11/2004 | Mamiya | 112/102.5 |
| D499,751 | S | * | 12/2004 | Egami et al. | D15/66 |
| 6,883,447 | B1 | * | 4/2005 | Kitazawa | 112/302 |
| 6,981,459 | B1 | | 1/2006 | Kitazawa et al. | |
| 2004/0000263 | A1 | | 1/2004 | Sakakibara | |

FOREIGN PATENT DOCUMENTS

| | | | |
|---|---|---|---|
| JP | A-6-191351 | | 7/1994 |
| JP | A-2000-145272 | | 5/2000 |
| JP | A-2001-40569 | | 2/2001 |
| JP | 2002-189517 | | 6/2002 |
| JP | 2002191884 | * | 7/2002 |
| JP | A 2002-191886 | | 7/2002 |
| JP | A-2004-24765 | | 1/2004 |

* cited by examiner

*Primary Examiner*—Ismael Izaguirre
(74) *Attorney, Agent, or Firm*—Oliff & Berridge, PLC

(57) ABSTRACT

A sewing machine includes a sewing machine body formed with a cassette mount, a thread cassette having a supply of thread and detachably attached to the cassette mount, and a moving speed limiting unit limiting a moving speed of the thread cassette when the thread cassette is attached to the cassette mount. The moving speed limiting unit includes a moving member capable of moving substantially together with the thread cassette in the course of movement of the thread cassette to a predetermined position in the cassette mount, a rotating member rotated by movement of the moving member, and a rotational resistance applying unit applying rotational resistance to the rotating member.

10 Claims, 26 Drawing Sheets

10
120a
127
120
126a
126b
126
124a
124
124b
122
121
125

SEWING MACHINE AND THREAD CASSETTE ATTACHED THERETO

BACKGROUND OF THE INVENTION

1. Field of the Invention

This invention relates to a sewing machine in which a moving speed at which a thread cassette having a supply of thread is attached to a sewing machine body is limited.

2. Description of the Related Art

There have conventionally been provided sewing machines in which a thread cassette accommodating a supply of thread such as a thread spool is attached to a cassette mount provided in a sewing machine body. A user moves the thread cassette to attach the latter to the cassette mount. In this case, it is preferable that the thread cassette should be moved properly.

However, the user sometimes attaches the thread cassette to the cassette mount at a stroke. Thus, when the moving speed of the thread cassette exceeds a proper one, the thread cassette and/or the cassette mount may be damaged or broken due to a shock during attachment, or equipment installed in the sewing machine for sewing or sewing preparation may be broken.

Furthermore, in sewing machines including a threading mechanism operated in synchronization with attachment of the tread cassette, an operating force from the thread cassette is sometimes transmitted via an operating force transmitting member to the threading mechanism so that the threading mechanism is operated. The transmitting member transmits the operating force from the thread cassette to the threading mechanism. JP-A-2002-191886 discloses one of such sewing machines. In the disclosed sewing machine, the threading mechanism is not sometimes operated properly when the transmitting member moves too quickly. As a result, threading is not sometimes carried out normally, one or more components are sometimes broken or the thread is disturbed.

The foregoing problems also occur in sewing machines in which the operating force from the thread cassette is transmitted via the transmitting member to the thread carrying mechanism during attachment of the thread cassette so that the thread carrying mechanism is operated. Thus, when the transmitting member moves too quickly in these sewing machines, the thread carrying mechanism is operated at a higher speed than a normal operating speed such that the one or more components are sometimes broken or the thread is disturbed.

SUMMARY OF THE INVENTION

Therefor, an object of the present invention is to provide a sewing machine in which shock caused by the attachment of the thread cassette can be reduced and the operation of the threading mechanism or the thread carrying mechanism can be stabilized.

The present invention provides a sewing machine comprising a sewing machine body provided with a cassette mount, a thread cassette having a supply of thread and detachably attached to the cassette mount, and a moving speed limiting unit limiting a moving speed of the thread cassette when the thread cassette is attached to the cassette mount, the moving speed limiting unit including a moving member capable of moving substantially integrally with the thread cassette in the course of movement of the thread cassette to a predetermined position in the cassette mount, rotating member rotated by movement of the moving member, and a rotational resistance applying unit applying rotational resistance to the rotating member.

The moving speed of the thread cassette is limited by the moving speed limiting unit when the thread cassette is attached to the cassette mount, whereupon shock caused in the thread cassette or the sewing machine body can be reduced during attachment of the thread cassette.

In a preferred form, the moving member is a rack which is provided on the thread cassette so as to extend in a predetermined direction, the rotating member is a pinion which is provided on the sewing machine body so as to mesh the rack, and a rotational resistance applying unit applying rotational resistance to the pinion.

When the thread cassette is attached to the cassette mount, the rack is moved such that the pinion is rotated. At this time, the rotational resistance is applied to the pinion by the rotational resistance applying unit, whereupon the moving speed of the thread cassette is limited during attachment.

In another preferred form, the pinion is displaced between a meshing position where the pinion meshes the rack and a retreat position where the pinion is disengaged from the rack, and the moving speed limiting unit includes a switching mechanism switching the pinion to the meshing position when the thread cassette is attached to the cassette mount and to the retreat position when the thread cassette is detached from the cassette mount.

The pinion is switched to the meshing position by the switching mechanism when the thread cassette is attached to the cassette mount. When the thread cassette is detached from the cassette mount, the pinion is switched to the retreat position, whereupon the pinion is prevented from meshing the rack and accordingly, no rotational resistance is applied to the pinion.

BRIEF DESCRIPTION OF THE DRAWINGS

Other objects, advantages and features of the present invention will become clear upon reviewing the following description of embodiment, made with reference to the accompanying drawings, in which.

DETAILED DESCRIPTION OF THE INVENTION

One embodiment of the present invention will be described. In the embodiment, the present invention is applied to a household sewing machine in which a needle thread is automatically passed through an eye of a sewing needle in synchronization with attachment of a thread cassette.

Figure 1:
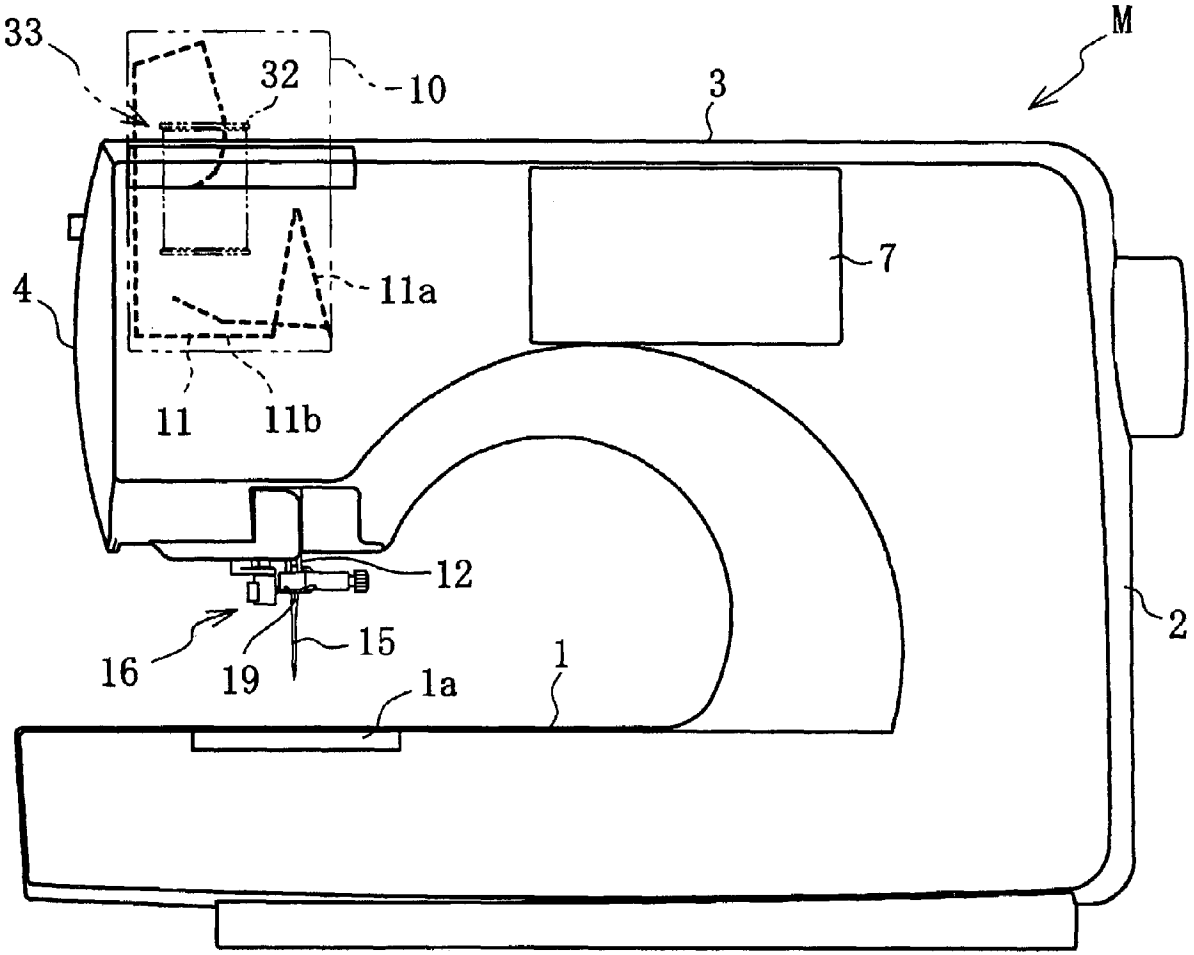
FIG. 1 is a front view of a sewing machine in accordance with one embodiment of the present invention.
Figure 2:
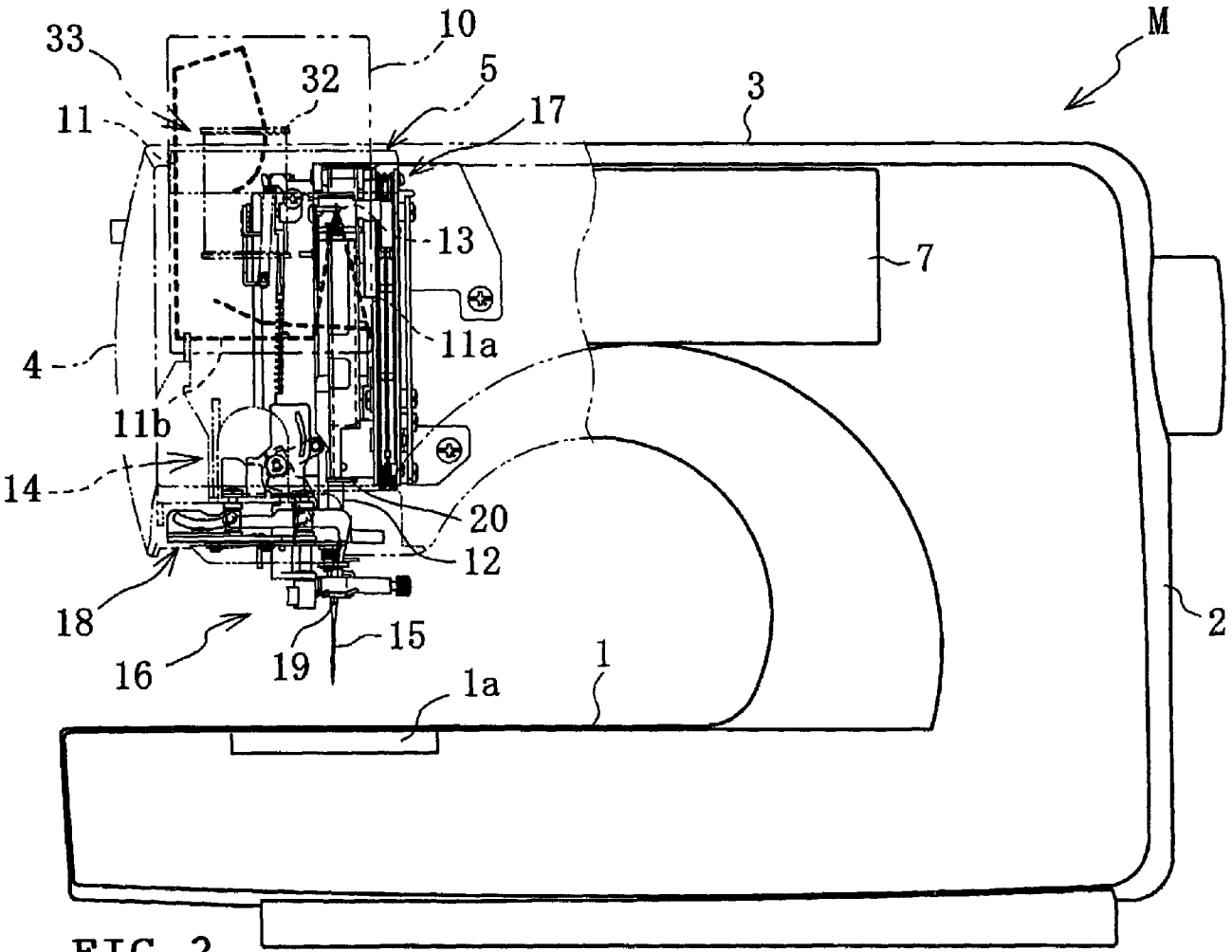
FIG. 2 is a partially cut-out front view of the sewing machine.

Referring to FIGS. 1 and 2, a household sewing machine M includes a sewing bed 1 having a horizontal bed plane, a pillar 2 standing from a right end of the bed 1, a sewing arm 3 extending leftward from an upper end of the pillar 2 so as to be opposed along the bed 1, and a machine head 4 located at a left end of the arm 3. The head 4 is provided with a cassette mount 5 to which a thread cassette 10 is detachably attached. A needle thread 11 is drawn from the thread cassette 10. The arm 3 or the head 4 thereof includes operation switches 6 (not shown) such as a sewing start switch, sewing finish switch, etc. The arm 3 further includes a liquid crystal display 7.

Figure 3:
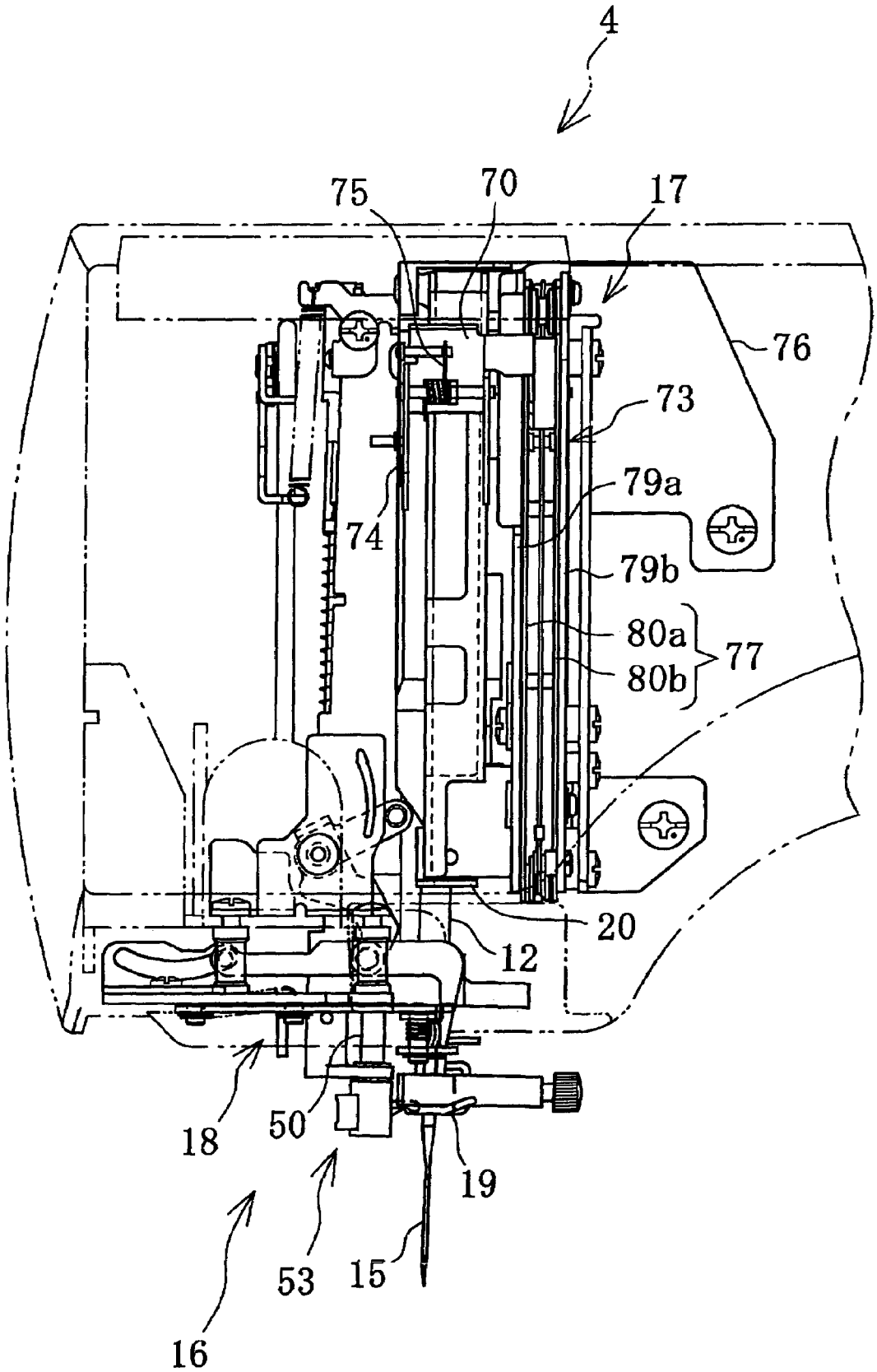
FIG. 3 is an enlarged view of the major part of the sewing machine shown in FIG. 2.
Figure 4:
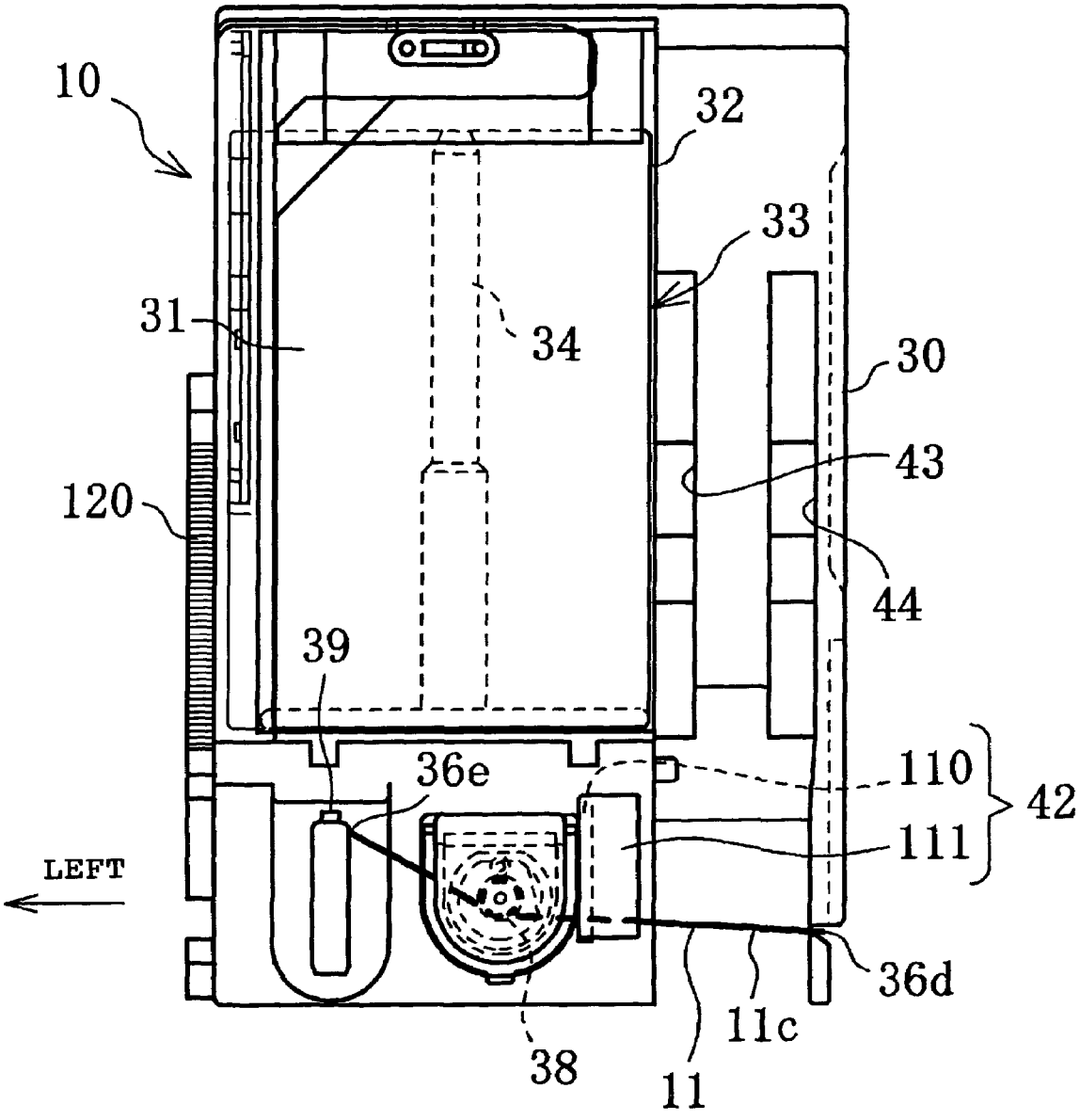
FIG. 4 is a front view of a thread cassette.
Figure 5:
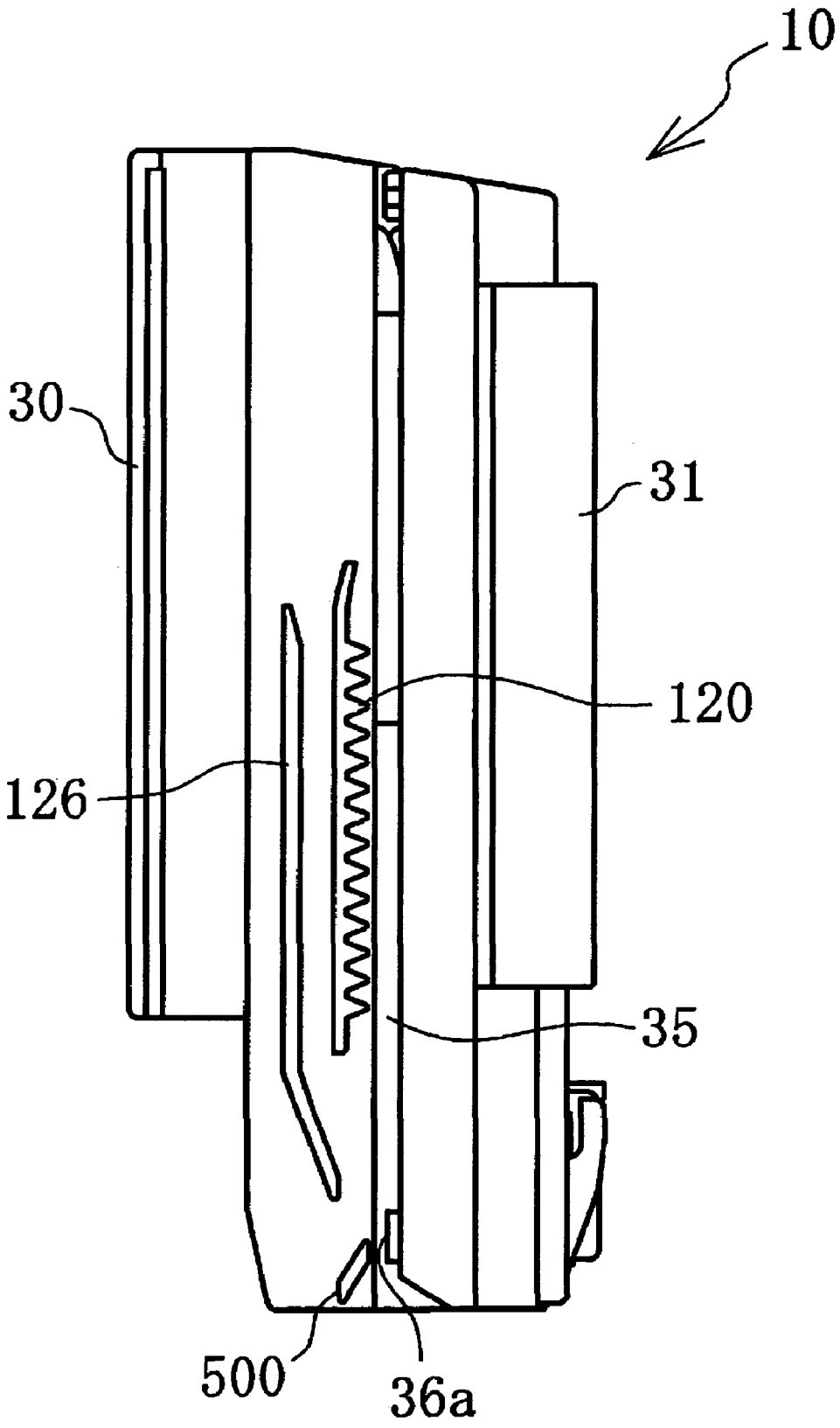
FIG. 5 is a left side view of the thread cassette.
Figure 15:
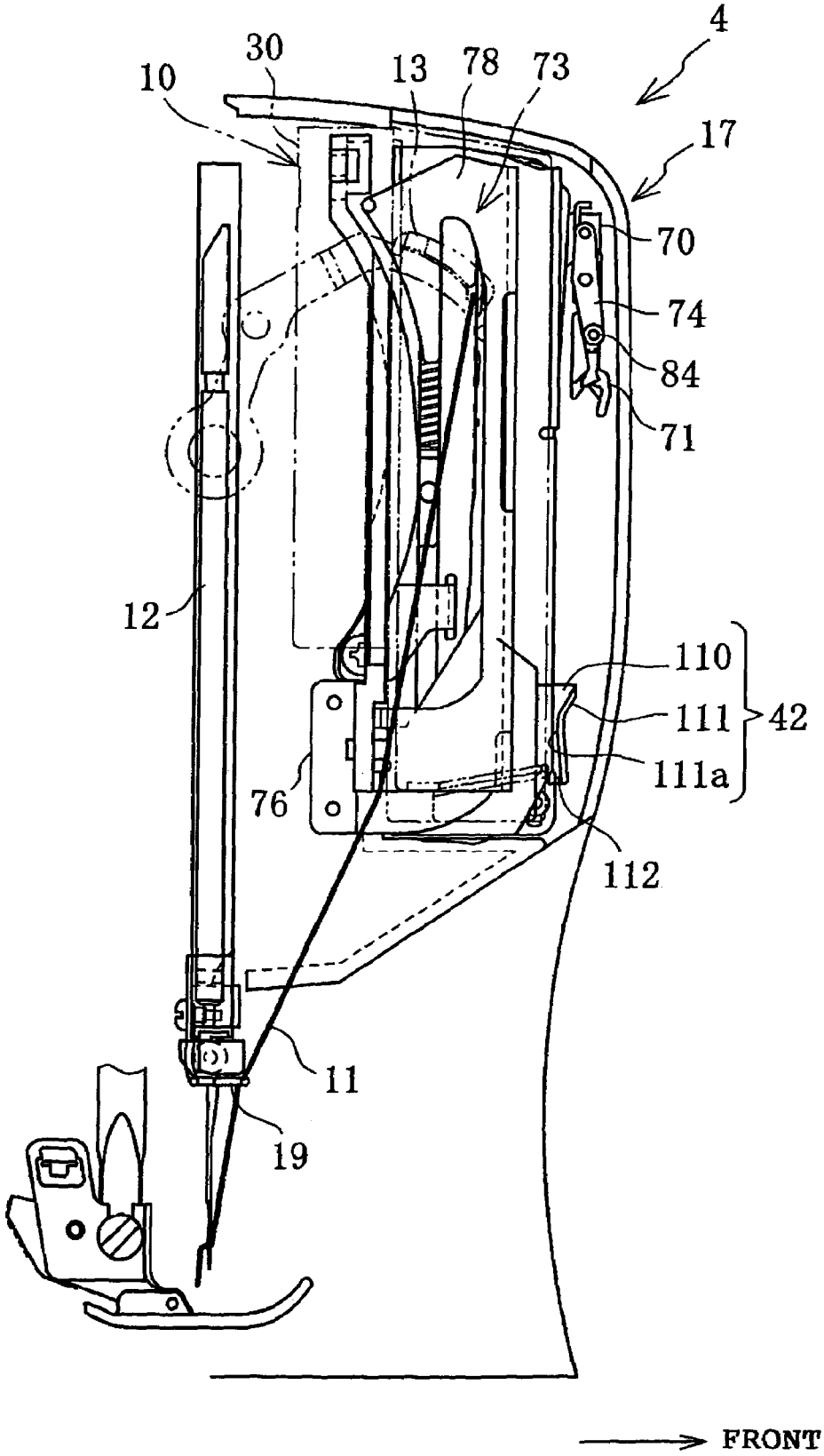
FIG. 15 is a left side view of a major part of the head after completion of threading.

Referring now to FIGS. 2 and 3, the head 4 is provided with a needle bar 12, a needle thread take-up lever 13 (see FIG. 15), a thread tensioning mechanism 14 adjusting a thread tension of the needle thread 11, a threading mechanism 16, and a major part of a thread carrying mechanism 17, and a needle bar threading mechanism 18. The needle bar threading mechanism 18 automatically threads a first thread guide 19 provided on a lower end of the needle bar 12 and a second thread guide 20 located near the lower end of the head 4.

Figure 9:
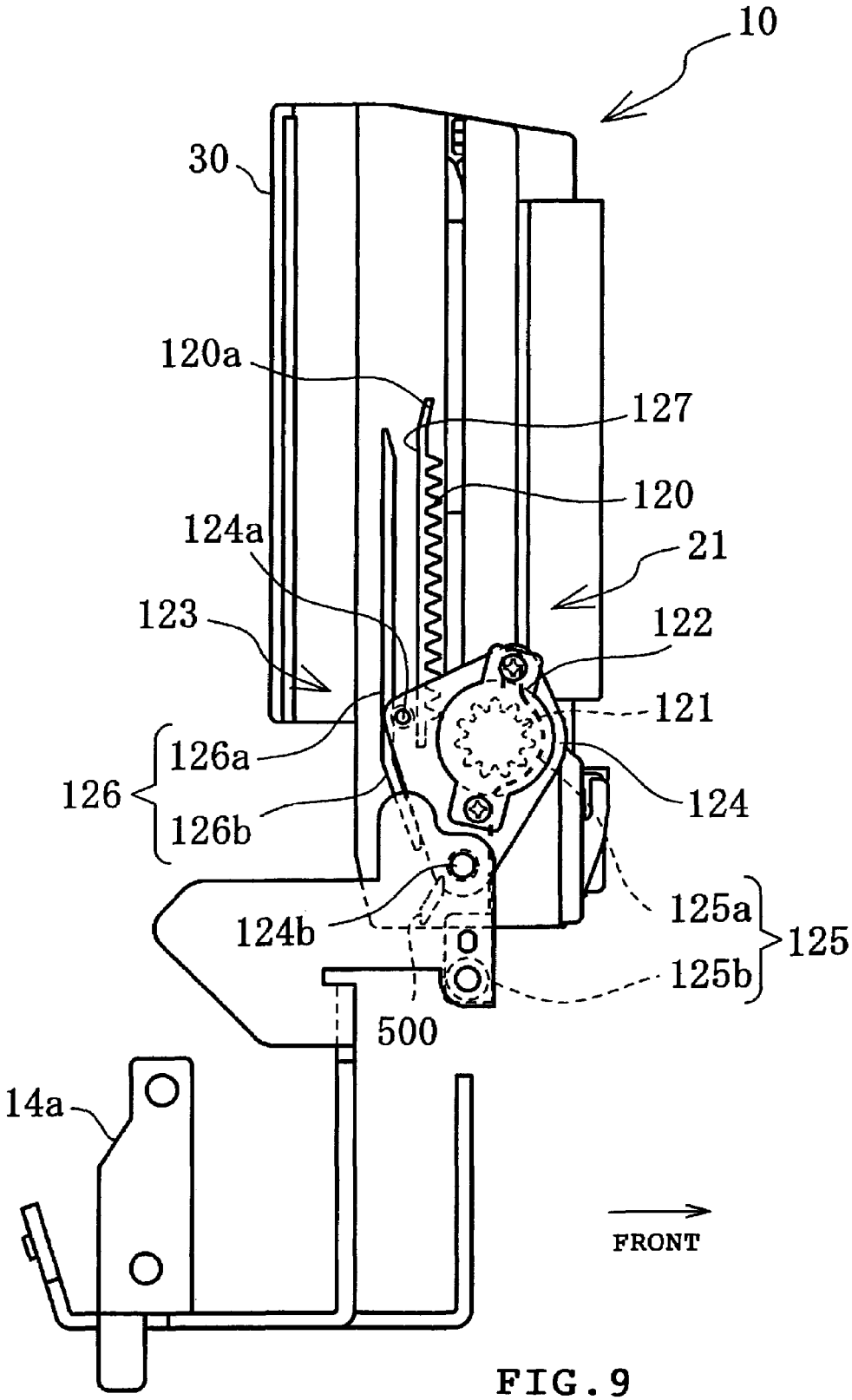
FIG. 9 is a left side view of the thread cassette and a moving speed limiting mechanism.
Figure 10:
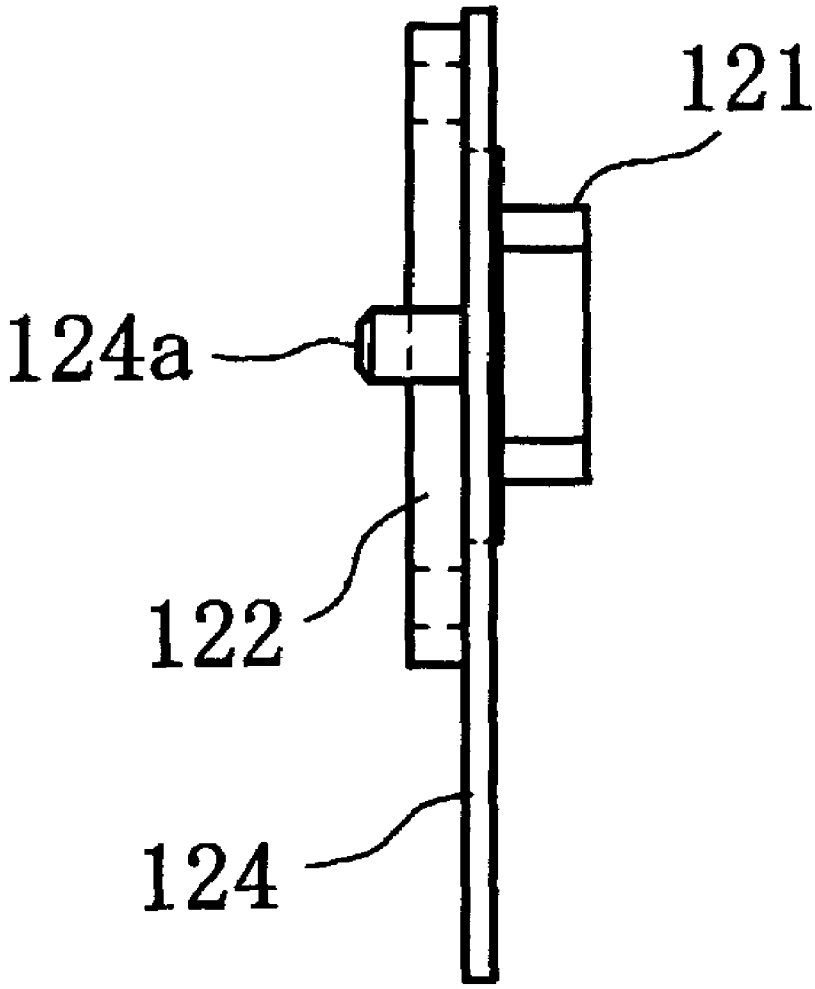
FIG. 10 is a front view of a pinion, pinion holding plate and rotational resistance applying member.

The sewing machine M further includes a moving speed limiting mechanism 21 (a moving speed limiting unit; and see FIG. 9) limiting a moving speed of the thread cassette 10 during attachment of the cassette, a threading operating member 66 (see FIG. 13) corresponding to an operating force transmitting member and an operating force transmitting member for the threading mechanism and a cassette contact 90 (see FIG. 17) corresponding to an operating force transmitting member and an operating force transmitting member for the thread carrying mechanism.

Referring to FIGS. 1 and 2, the needle thread 11 drawn from the thread cassette 10 attached to the cassette mount 5 is placed on a thread tension shaft (not shown) disposed between a pair of thread tension discs of the thread tensioning mechanism 14. The needle thread 11 extending downstream from the thread tension shaft is caught on the needle thread take-up lever 13. The threading mechanism 16 and thread carrying mechanism 17 are constructed so as to pass the needle thread 11 through an eye 15*a* of a sewing needle 15 in synchronization with attachment of the thread cassette 10. As the thread cassette 10 is further attached to the cassette mount 5, the needle thread 11 extending downstream from the needle thread take-up lever 13 is held near the needle eye 15*a* by the thread carrying mechanism 17. Thereafter, the needle thread 11 is passed through the needle eye 15*a* and caught on the two thread guides 19 and 20 by the threading mechanism 18. Thus, the needle thread 11 is set in the sewing machine M so that a sewing operation can be carried out. In order that the needle thread 11 may be passed through the needle eye 15*a* by the threading mechanism 16 in synchronization with attachment of the thread cassette 10, the sewing machine M is constructed so that the needle bar 12 is located at predetermined position above a needle plate 1*a* before attachment of the thread cassette.

The bed 1 is provided with a bobbin mount (not shown) to which a bobbin (not shown) is detachably attached. A thread drawn from the bobbin serves as a bobbin thread. The bed 1 is further provided with a shuttle mechanism (not shown). When the needle and bobbin threads are set for the sewing operation and a sewing machine motor 9 (not shown) is driven, the needle bar 12 is vertically moved by a needle bar vertically moving mechanism (not shown). The shuttle mechanism is driven in synchronization with the vertical movement of the needle bar 12 so that the needle thread 11 near the needle 15 lowered below a needle plate 1*a* of the bed 1, whereupon the needle and bobbin threads are entangled to be formed into stitches.

The thread cassette 10 will now be described. Referring to FIGS. 4 to 7, the thread cassette 10 comprises a cassette body 30 and a lid 31 pivotally mounted on the body. The cassette body 30 with the lid 31 defines therein a thread accommodating cavity 33 for accommodating a thread spool 32 serving as a supply of thread. A spool pin 34 is mounted on the lid 21.

The needle thread 11 is set as follows when the preparation for attaching the thread cassette 10 to the cassette mount 5 has been completed. That is, the needle thread 11 extends upward from the thread spool 32 to be drawn out of the thread accommodating cavity 33. The needle thread 11 further extends through a thread path 35 defined between the cassette body 30 and a left end of the lid 31. The needle thread 11 is then put on a first thread guard 36*a* at a left lower end of the thread cassette 10, further extending rightward thereafter to be put on a second thread guard 36*b* at a lower end of a partition wall 37 and a third thread guard 36*c* at a right lower end of the thread cassette 10. The needle thread 11 further extends forward to be put on a fourth thread guard 36*d* and is then returned to extend leftward. The needle thread 11 is then retained on a thread retainer 38. Furthermore, the needle thread 11 extending leftward is cut by a left blade 39 of the thread retainer 38 and the resultant end is put on a fifth thread guard 36*e* near the blade 39.

A needle thread take-up lever guide space 40 defined at a right end of the thread cassette 10 extends substantially over the length of the cassette. The guide space 40 is open at the rear and the lower portion thereof. The thread cassette 10 has a thread tensioning space 41 defined in the central lower end. The thread tensioning space 41 is open at the lower portion thereof. These spaces 40 and 41 are partitioned by the partition wall 37. The right front of the thread cassette 10 is formed with a pair of left and right escape grooves 43 and 44. The escape grooves 43 and 44 prevent a holding member 70 of the thread carrying mechanism 17 from interfering with the right front of the thread cassette 10.

Figure 6:
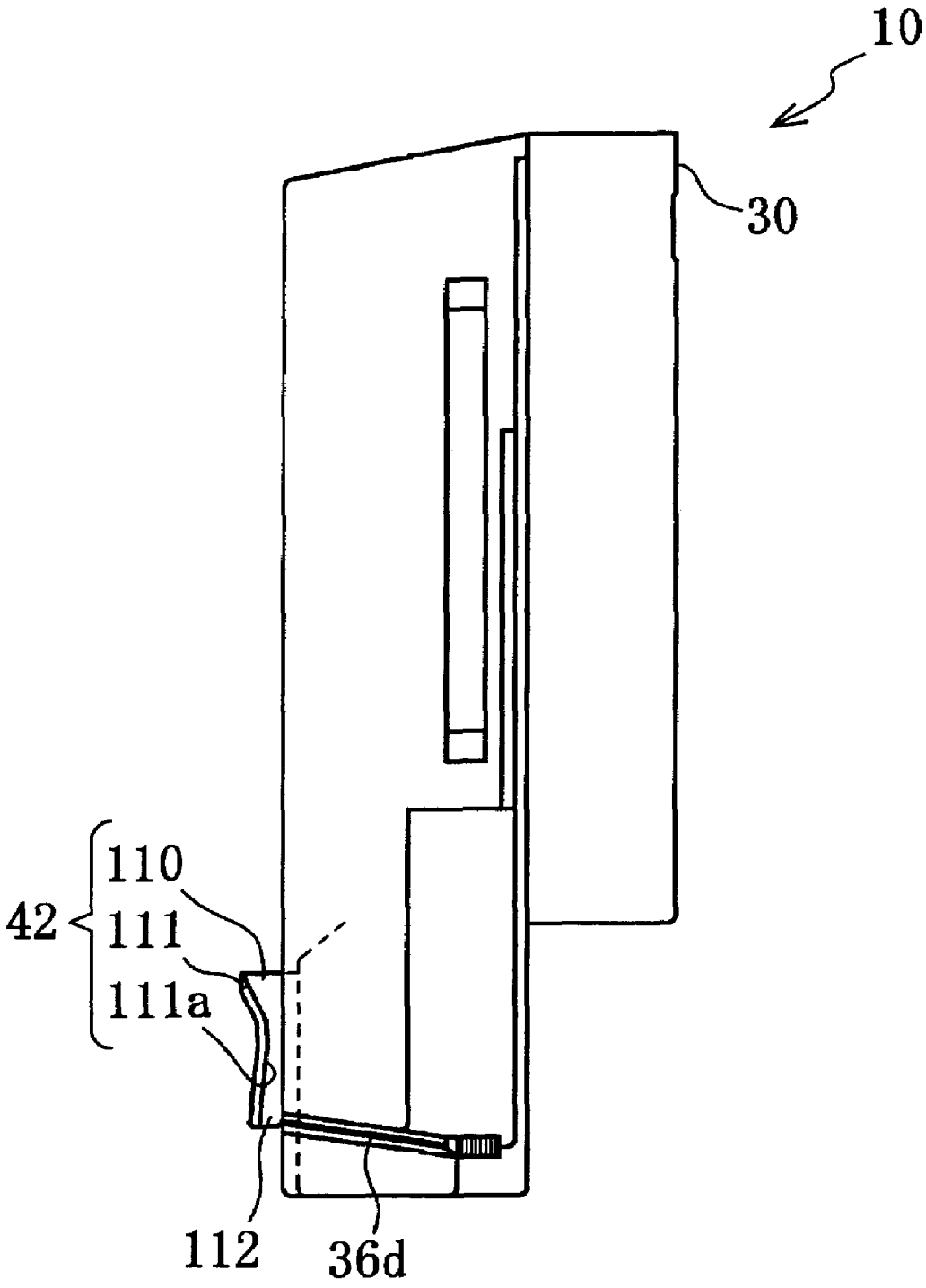
FIG. 6 is a right side view of the thread cassette.
Figure 7:
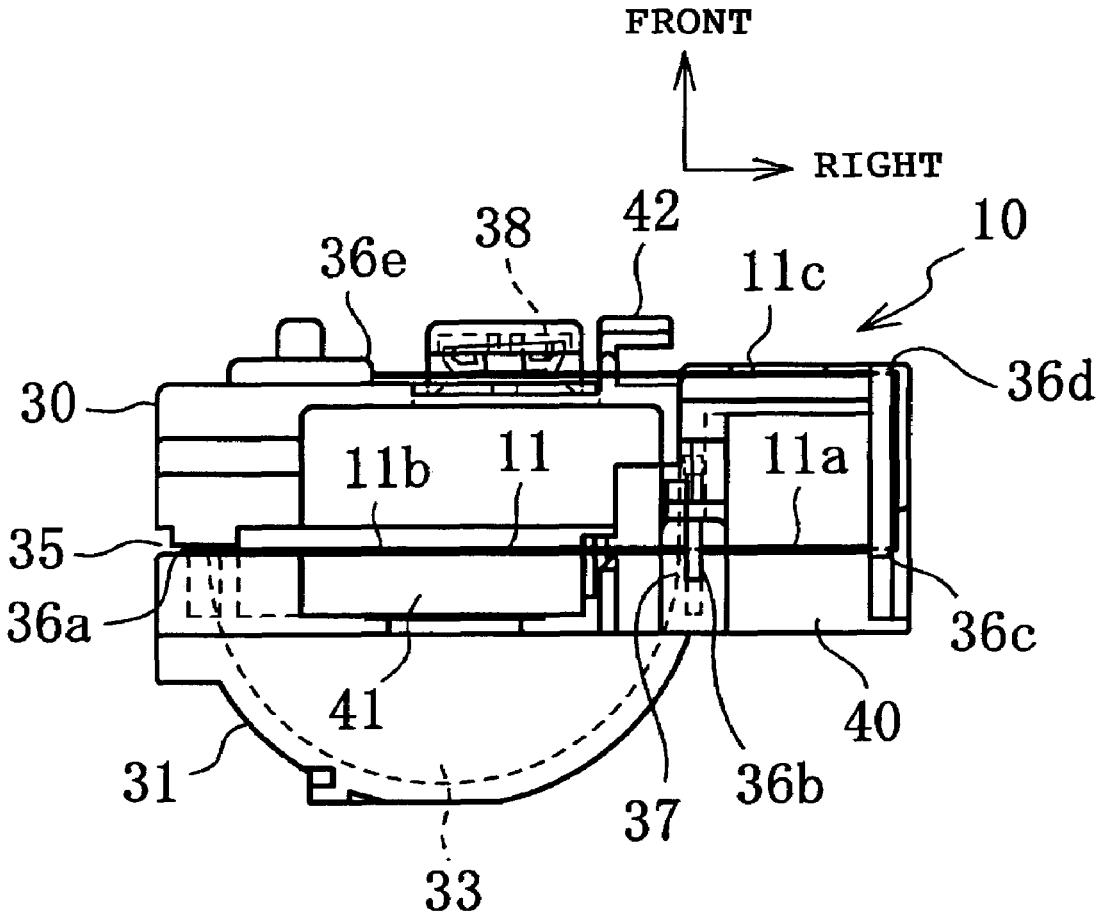
FIG. 7 is a bottom view of the thread cassette.
Figure 8:
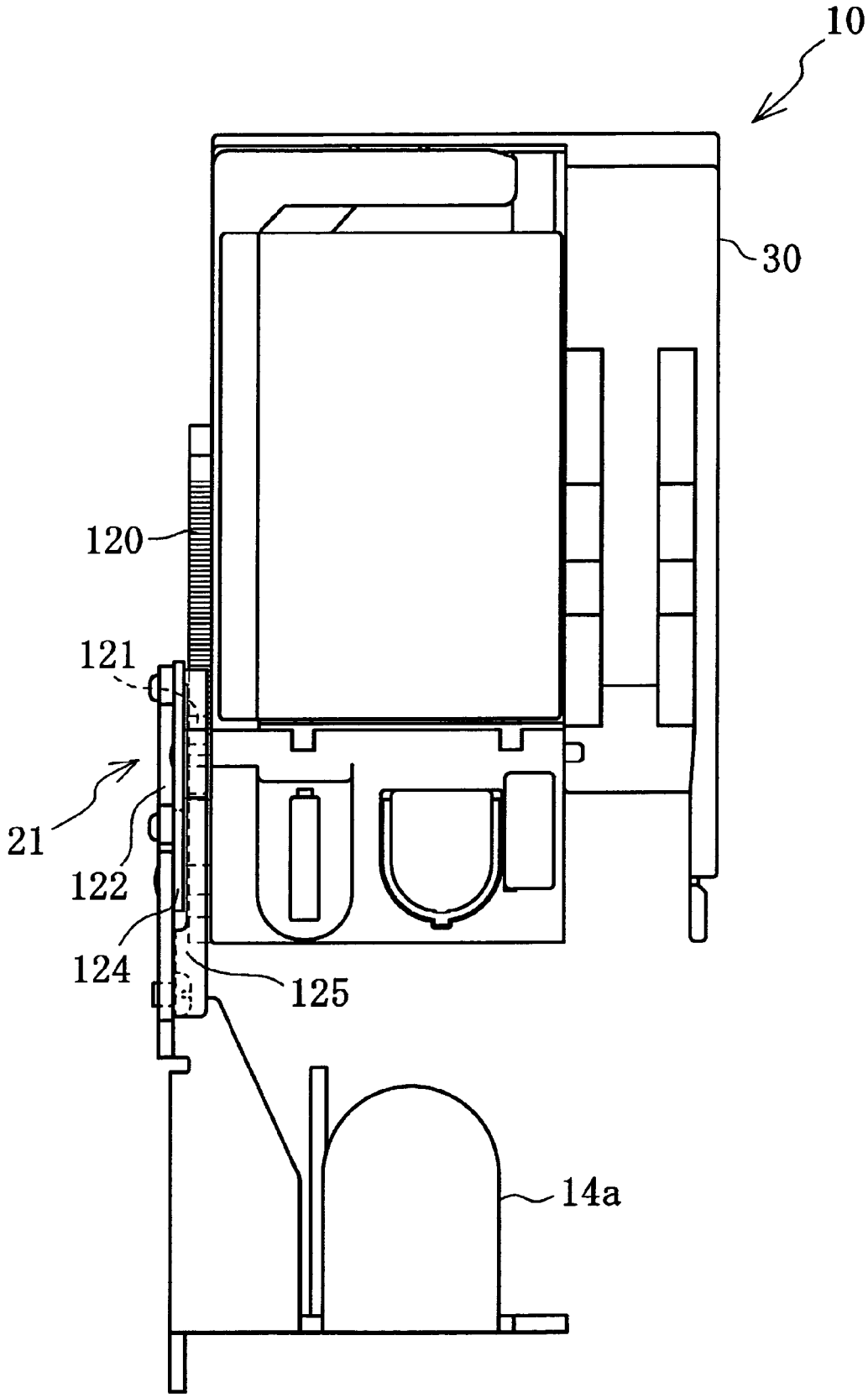
FIG. 8 is a front view of the thread cassette and a moving speed limiting mechanism.

Referring to FIGS. 6 to 8, when the thread cassette 10 is inserted into the cassette mount 5 from above, the needle thread take-up lever 31 enters the guide space 40 from below the cassette, whereas the thread tensioning mechanism 14 enters the thread tensioning space 41 from below the cassette 10. When the thread cassette 10 has been inserted to the lower end of the cassette mount 5, a thread part 11*a* between the thread guards 36*b* and 36*c* is caught by the needle thread take-up lever 13 in the guide space 40. Subsequently, when the thread cassette 10 is further inserted into the cassette mount 5, a thread part 11*b* between the thread guards 36*a* and 36*b* is held by the thread tensioning mechanism 14 in the thread tensioning space 41.

Figure 26:
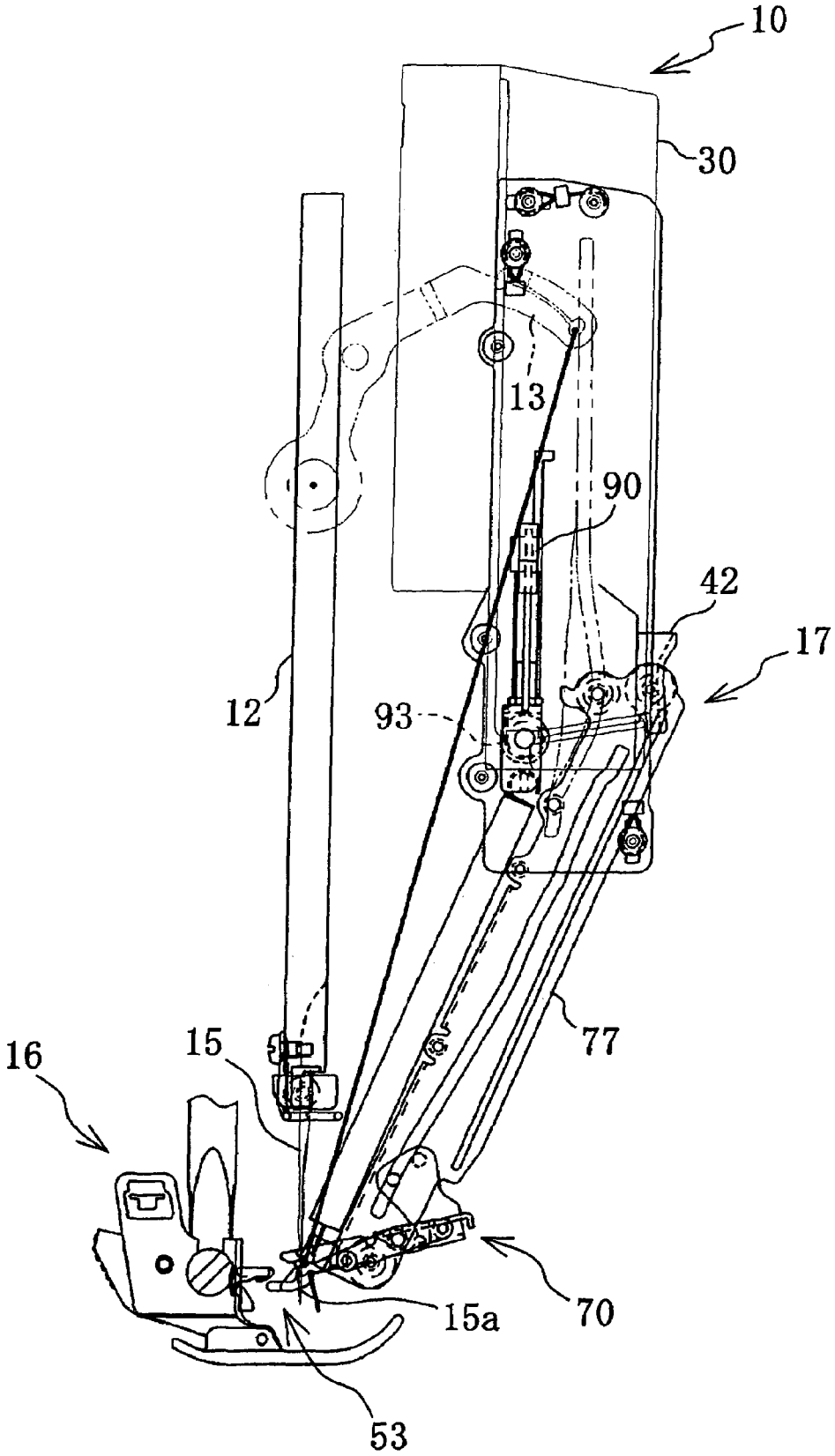
FIG. 26 is a left side view of a major part of the head after completion of threading.

On the other hand, a thread part 11*c* between the thread guard 36*d* and the thread retainer 38 is drawn near the needle eye 15*a* by the thread carrying mechanism 17 to be held in position (see FIG. 26). A cam member 42 which will be described in detail later is provided between the thread guard 36*d* and the thread retainer 38 for rocking a thread holding member 74 of the thread carrying mechanism 17. On the left side of the thread cassette 10 are provided a rack 120 of a moving speed limiting mechanism 21 serving as a moving speed limiting unit and a switching and guiding member 126. The mechanism 21 will be described in detail later.

The moving speed limiting mechanism 21 will be described. Referring to FIGS. 8 to 12E, the moving speed limiting mechanism 21 comprises the rack 120 which serves as a moving member capable of moving substantially together with the thread cassette 10 in the course of movement of the thread cassette 10 to a mounting position, a pinion 121 which serves as a rotating member rotated by movement of the rack 120 and a rotational resistance applying member 122 (a rotational resistance applying unit). The rack 120 is mounted on the thread cassette 10 so as to extend downward. The pinion 121 is provided on the machine head 4 so as to be displaced or more specifically rocked between a meshing position where the pinion meshes the rack 120 and a retreat position where the pinion is disengaged from the rack 120. The rotational resistance applying member 122 applies rotational resistance to the pinion 121. The moving speed limiting mechanism 21 further includes a switching mechanism 123 switching the pinion 121 to the meshing position when the thread cassette 10 is attached to the cassette mount 5 and to the retreat position when the thread cassette 10 is detached from the cassette mount 5.

The rack 120 extends downward from the vertically middle of the left side of the cassette body 30 and projects leftward. The rack 120 has teeth formed on the front thereof. The pinion 121 is rotatably mounted on a pinion support plate 124. The support plate 124 is further mounted, for rocking motion, on a frame member 14*a* supporting the thread tensioning shaft of the thread tensioning mechanism 14 with a shaft 124*b* serving as a rocking axis. The pinion support plate 124 includes a right rear end from which a driven pin 124*a* projects rightward. The driven pin 124*a* is operated by the switching and guiding member 126 so that the pinion 121 is switched from the meshing position to the retreat position. The driven pin 124*a* is received by a receiving member 120*a* formed on an upper end of the rack 120 when the pinion 121 is switched from the meshing position to the retreat position.

The pinion 121 is mounted on the rotational resistance applying member 122 which is further mounted on the pinion support plate 124. The interior of the rotational resistance applying member 122 is filled with a fluid such as grease. The rotational resistance applying member 122 applies rotational resistance to the pinion 121 by means of viscous resistance of the grease.

Figures 11A, 11B, 11C, 11D, 11E:
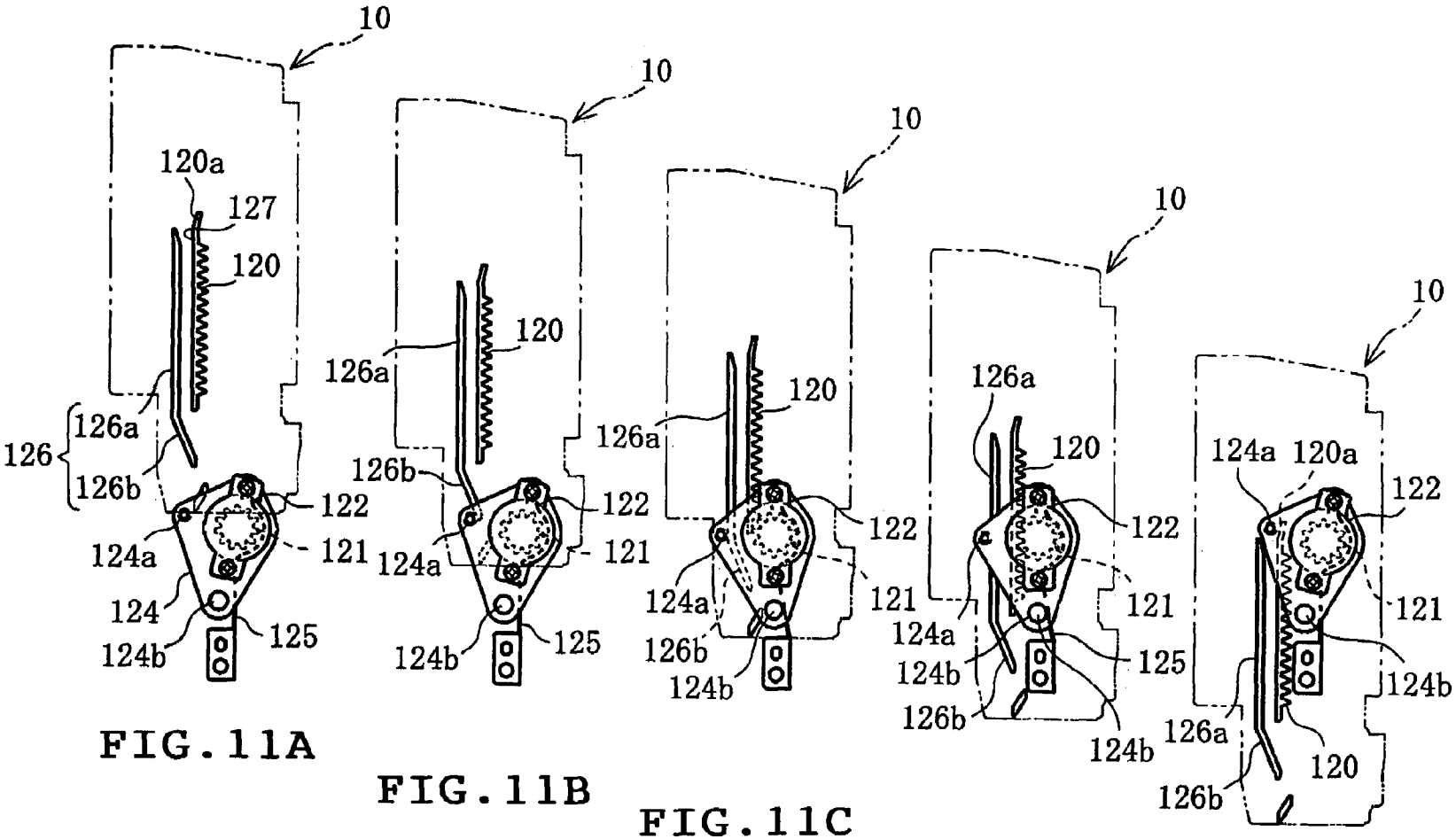
FIGS. 11A and 11B schematically illustrate the moving speed limiting mechanism immediately before attachment of the thread cassette and upon start of attachment of the thread cassette, respectively.
FIGS. 11C and 11D illustrate a rack and pinion in mesh engagement.
FIG. 11E schematically illustrates the moving speed limiting mechanism upon completion of attachment.

In the attachment of the thread cassette 10 to the cassette mount 5, the pinion 121 is switched to the meshing position where the pinion meshes the rack 120, when the pinion support plate 124 is rocked rearward, as shown in FIGS. 11C and 11D. On the other hand, when the pinion support plate 124 is rocked forward, the pinion 121 is switched to the retreat position where the pinion is prevented from meshing the rack 120, as shown in FIG. 11E.

A switching mechanism 123 comprises a leaf spring 125 (a biasing member) and a switching and guiding member 126. The leaf spring 125 biases the pinion 121 from the meshing position toward the retreat position. The switching and guiding member 126 is provided on the cassette body 30. When the thread cassette 10 is attached to the cassette mount 5, the pinion 121 is switched against a biasing force of the leaf spring 125 from retreat position to the meshing position. The switching and guiding member 126 further guides the rack 120 moved in mesh engagement with the pinion 121.

The leaf spring 125 has an upper end 125*a* (a free end) connected to an upper end of the pinion support plate 124 located over the shaft 124*b*. The leaf spring 125 further has a lower end 125*b* (a fixed end) fixed to the frame member 14*a*. The leaf spring 125 biases the pinion support plate 124 so that the plate 124 stands substantially upright. The switching and guiding member 126 is formed integrally on the cassette body 30 so that a portion thereof located in the rear of the rack 120 extends downward. The switching and guiding mechanism 126 includes a parallel guide portion 126*a* and an inclined guide portion 126*b*. The parallel guide portion 126*a* is located slightly lower than the receiving member 120*a* of the rack 120 and extends downward in parallel to the rack. The inclined guide portion 126*b* is located below the rack 120 and extends from the lower end of the parallel guide portion 126*a* so as to be bent obliquely downward. A guide groove 127 is formed between the rack 120 and the parallel guide portion 126*a*. The guide groove 127 guides the driven pin 124*a* when the thread cassette 10 is detached from the cassette mount 5. Furthermore, a guide protrusion 500 (see FIG. 5) is formed on a lower part of the switching and guiding member 126. The guide protrusion 500 adjusts the direction of the cassette body 30 relative to the opening of the cassette mount 5 when the thread cassette 10 is attached to the cassette mount 5.

As the thread cassette 10 is inserted into the cassette mount 5 from above, the pinion support plate 124 subjected to the biasing force of the leaf spring 125 thereby to stand upright as shown in FIG. 11A is moved upward relative to the thread cassette 10 in the rear of the switching and guiding member 126 while the driven pin 124*a* is being guided by the inclined guide portion 126*b*, as shown in FIG. 11B. With this movement, the pinion support plate 124 is rocked rearward against the biasing force of the leaf spring 125, whereupon the pinion 121 is switched to the meshing position where the pinion meshes the rack 120, as shown in FIG. 11C.

When the thread cassette 10 is further inserted into the casseffe mount 5 while the pinion 121 is in mesh engagement with the rack 120, the rack is moved downward with the driven pin 124*a* being guided by the parallel guiding portion 126*a* as shown in FIG. 11D. In other words, the pinion 121 is moved upward relative to the rack 120. Since rotational resistance is applied to the pinion 121 by the rotational resistance applying member 122, a resisting force acts on the thread cassette 10, so that attachment of the thread cassette 10 is retarded. When the driven pin 124*a* reaches the upper end of the switching and guiding member 126 such that the driven pin disengages from the switching and guiding member 126, the biasing force of the leaf spring 125 rocks the pinion support plate 124 and the pinion 121 forward. The driven pin 124*a* once abuts against the receiving portion 120*a* formed on the upper end of the rack 120. Subsequently, the pinion support plate 124 is caused to stand upright so that the pinion 121 is departed from the rack 120 to be switched to the retreat position where the pinion is prevented from meshing the rack.

Figures 12A, 12B, 12C, 12D, 12E:
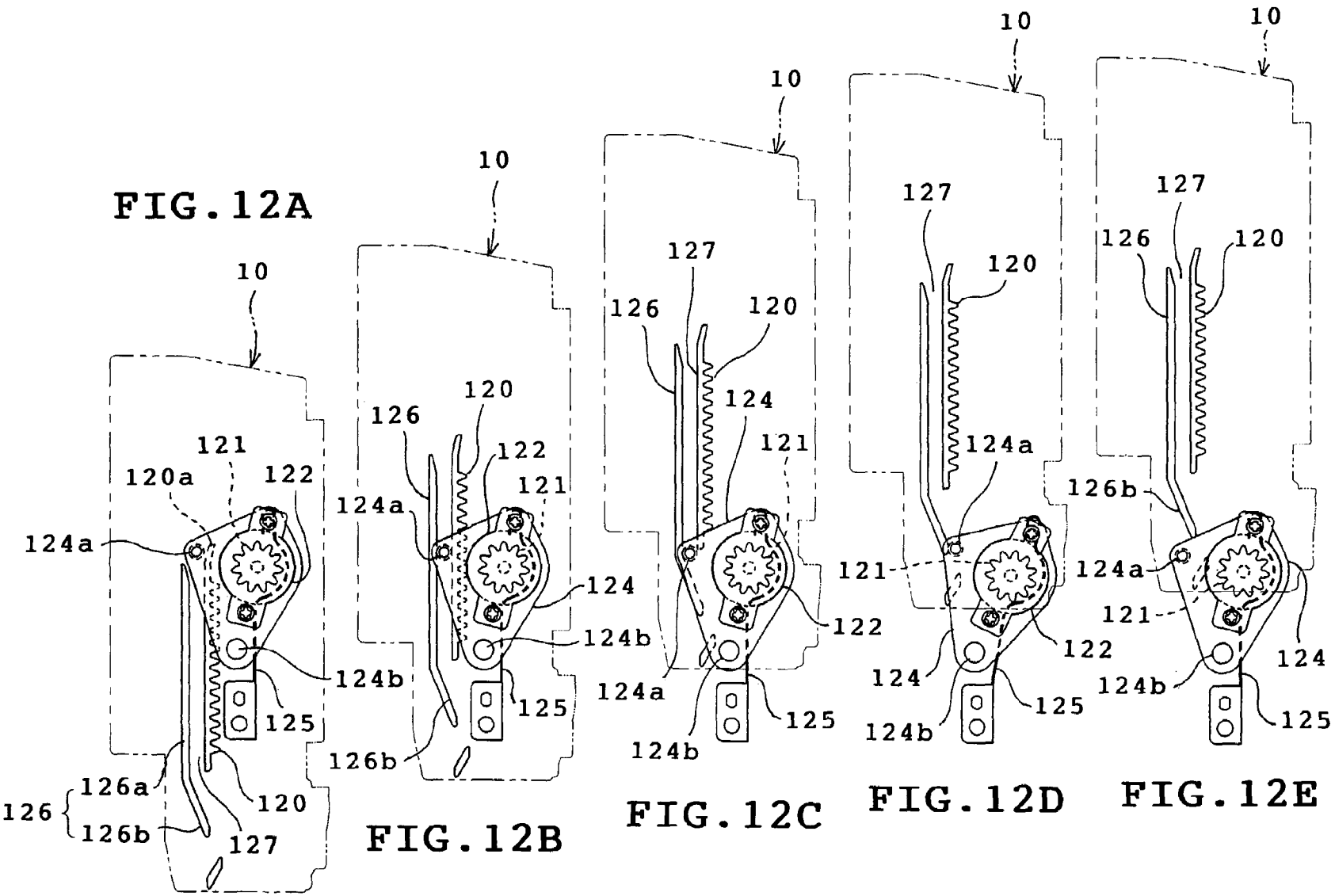
FIG. 12A schematically illustrate the moving speed limiting mechanism immediately before detachment of the thread cassette.
FIGS. 12B and 12C schematically illustrate the moving speed limiting mechanism during detachment of the thread cassette.
FIGS. 12D and 12E schematically illustrate the moving speed limiting mechanism immediately before and upon arrival at a position where the thread cassette is detachable respectively.

On the other hand, when the thread cassette 10 is detached from the cassette mount 5, the pinion 121 is switched to the retreat position upon completion of attachment of the thread cassette 10 to be held at the retreat position by the biasing force of the leaf spring 125 as described above. Accordingly, the driven pin 125 enters the guide groove 127 defined between the rack 120 and the switching and guiding member 126 from the condition as shown in FIG. 12A without mesh engagement of the rack and pinion. When the thread cassette 10 is then moved upward, the rear of the rack 120 is guided by the driven pin 124*a* (see FIG. 12B). When reaching the lower end of the guide groove 127, the driven pin 124*a* is pressed forward against the biasing force of the leaf spring 125 by the inclined guide portion 126*b*, as shown in FIG. 12C. The pinion support plate 124 is then rocked forward as shown in FIG. 12D. When the driven pin 124*a* is then disengaged from the inclined guide portion 126*b*, the biasing force of the leaf spring 125 rocks the pinion support plate 124 rearward, so that the pinion support plate 124 is caused to stand upright.

Figure 13A:
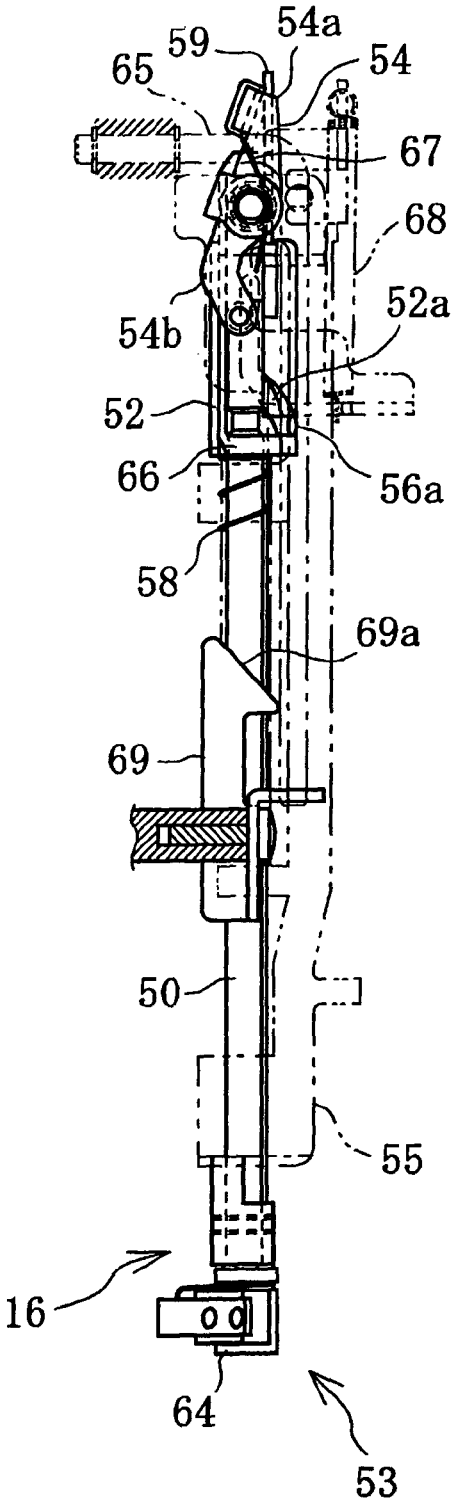
FIGS. 13A and 13B are left side and front views of the threading mechanism.
Figure 13B:
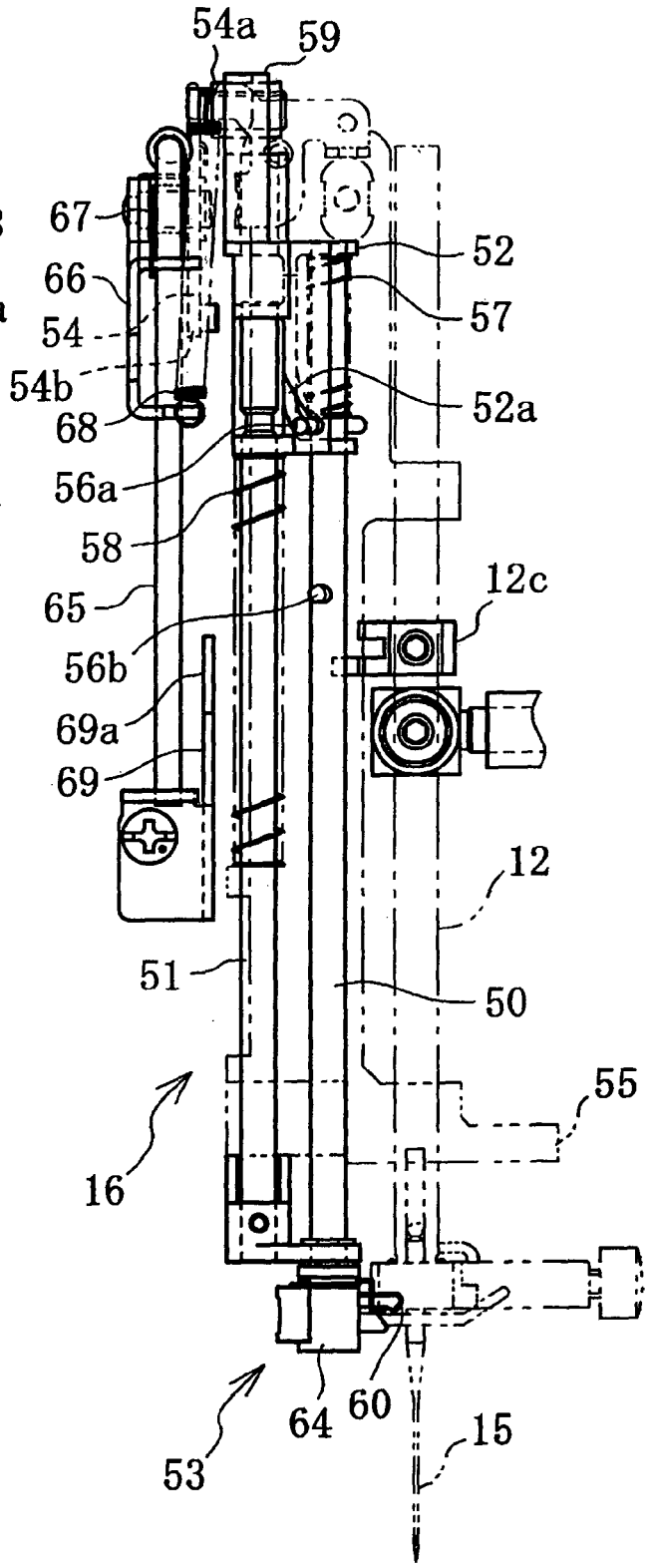

The threading mechanism 16 will now be described. Referring to FIGS. 13A and 13B, the threading mechanism 16 comprises a threading shaft 50, a slider guide shaft 51, a slider 52, a hook mechanism 53, a threading shaft driving member 54 and a threading operation member 66. The threading shaft 50 and slider guide shaft 51 are provided on the left of the needle bar 12 so as to be vertically moved. The slider 52 is fitted with upper ends of the threading shaft 50 and slider guide shaft 51 so as to be vertically moved. The hook mechanism 53 is connected to a lower end of the threading shaft 50 so that the needle thread 11 is passed through the needle eye 15*a* in synchronization with the pivotal movement of the threading shaft 50. The threading shaft driving member 54 drives the threading shaft 50 downward in synchronization with attachment of the thread cassette 10. The threading operation member 66 is pressed by the thread cassette 10 so that an operating force for operation of the threading mechanism is transmitted to the threading shaft driving member 54.

The threading shaft 50 and slider guide shaft 51 are mounted on a needle bar base 55 together with the needle bar 12 so that the needle bar 12, needle bar base 55, threading shaft 50 and slider guide shaft 51 are rocked together. Under the condition immediately before the threading operation (the condition immediately before attachment of the thread cassette 10), the needle bar 12 is located at a position where the needle thread 11 can be passed through the needle eye 15*a* or more specifically, a predetermined position slightly lower than an uppermost position.

Two pin members 56*a* and 56*b* protrude from an upper end and vertically middle portion of the threading shaft 50. The pin member 56*b* engages a limiting member 13*c* fixed to the vertically middle portion of the threading shaft 50 when the threading shaft 50 is lowered a predetermined amount. The threading shaft 50 is further provided with a coil spring 57 upwardly biasing the threading slider 52. The slider guide shaft 51 has an upper half around which a coil spring 58 upwardly biasing the threading slider 52 is provided. The threading slider 52 is formed with a cam groove 52*a* including an upper half straight groove and a lower half spiral groove. The threading slider 52 is further provided with a protruding plate 59 protruding upward. The protruding plate 59 includes a rear face further including a horizontal face (not shown).

Figure 14A:
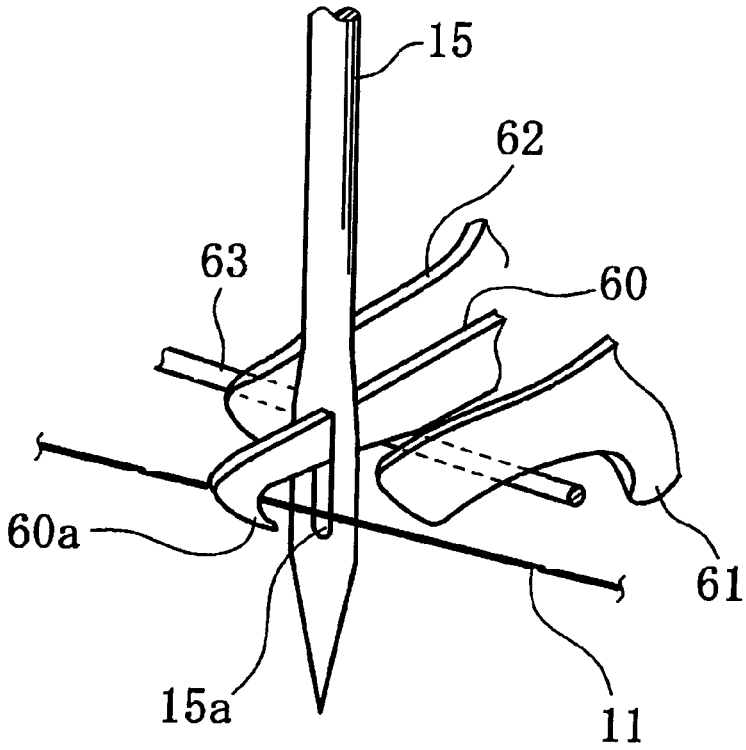
FIGS. 14A and 14B are perspective views of a hook mechanism immediately before and upon completion of threading respectively.
Figure 14B:
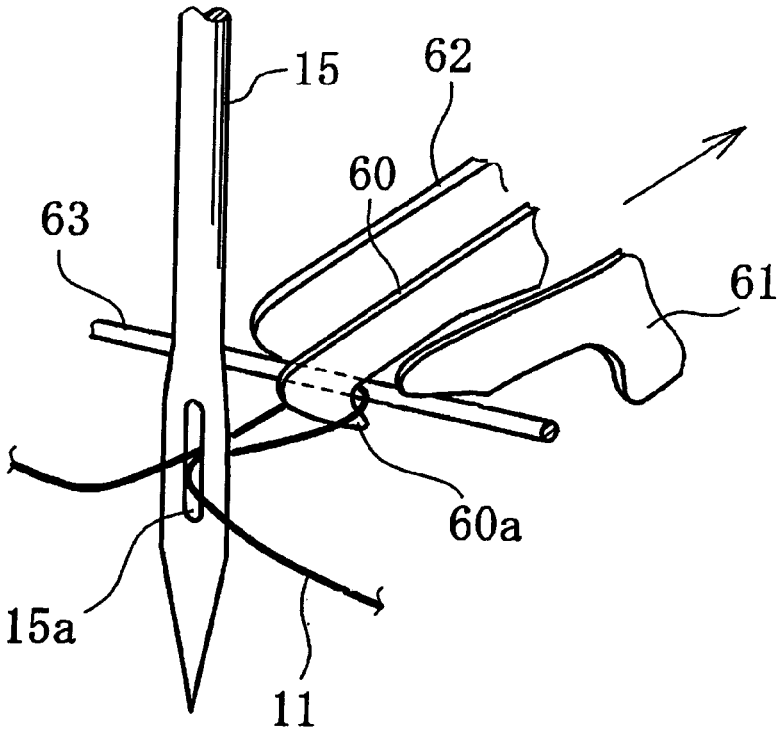

Referring to FIGS. 13A to 14B, the hook mechanism 53 includes a threading hook 60 catching the needle thread 11, two guide members 61 and 62 located at both sides of the threading hook 60 respectively, a thread holding wire 90 horizontally extending through the threading hook 60 and guide members 61 and 62, and a hook holding member 64 fixed to the lower end of the threading shaft 50 to hold the threading hook 60, guide members 61 and 62, etc. The threading hook 60 has a distal end formed with hook portion 60*a* as shown in FIGS. 14A and 14B. The hook portion 60*a* is inserted through the needle eye 15*a* when the sewing machine M is threaded. The needle thread 11 held near the needle eye 15*a* by the thread carrying mechanism 17 is caught by the threading hook 60 while the hook is guided by the two guide members 61 and 62 disposed at opposite sides thereof.

The threading shaft driving member 54 is rotatably coupled with the threading operation member 66 provided on the guide shaft 65 so as to be vertically moved. The threading shaft driving member 54 is biased clockwise in FIG. 13A by a torsion coil spring 67. On the other hand, the threading operation member 66 is biased upward by a coil spring 68. The lower end of the cassette body 30 abuts against the lower end of the threading operation member 66 when the thread cassette 10 is attached to the cassette mount 5. The threading operation member 66 is pressed downward against the biasing force of the coil spring 68. A driving force transmitting portion 54*a* is formed on an upper end of the threading shaft driving member 54. The driving force transmitting portion 54*a* abuts the horizontal face of the protruding plate 59 to transmit the driving force at the time of attachment of the thread cassette 10 to the threading slider 52.

The threading shaft driving member 54 has a lower end formed with a cam portion 54*b* shutting off transmission of drive force to the threading slider 52. On the other hand, the guide shaft 65 has a lower end to which a cam member 69 having an inclined distal cam portion 69*a* is fixed. The cam portion 54*b* abuts against the distal cam portion 69*a* when the threading shaft driving member 54 is moved downward a predetermined amount.

The threading operation by the threading mechanism 16 will now be described. When the user attaches the thread cassette 10 to the cassette mount 5, an operating force is transmitted from the thread cassette to the threading operation member 66, so that the member 66 is moved downward. The threading shaft driving member 54 is driven downward against the biasing force of the coil spring 68 in synchronization with the movement of the threading operation member 66. The driving force transmitting portion 54*a* is brought into contact with the horizontal face of the protruding plate 59 so that the driving force is transmitted to the plate 59. As a result, the threading shaft 50 and the slider guide shaft 51 are also moved downward. When the threading shaft 50 is moved downward a predetermined amount, the pin member 56*b* engages the limiting member 13*c*, whereby the threading shaft 50 is prevented from further downward movement, whereas the threading slider 52 is further moved downward against the biasing force of the coil spring 58.

The pin member 56*a* provided on the threading shaft 50 is then moved along the cam groove 52*a* of the threading slider 52. Accordingly, the downward movement of the threading slider relative to the threading shaft 50 is converted to a rotational movement of the threading shaft 50, whereupon the threading shaft 50 is rotated a predetermined angle. In this case, the hook mechanism 53 provided on the lower end of the threading shaft 50 is also rotated to the needle 15 side with the shaft 50, the hook portion 60*a* of the threading hook 60 is passed through the needle eye 15*a* to catch the needle thread 11, as shown in FIG. 14A.

The threading shaft driving member 54 is moved downward into a predetermined position and the cam portion 54*b* abuts the distal cam portion 69*a* of the cam member 69 when the hook portion 60*a* has caught the needle thread 11, as shown in FIG. 14A. When the thread cassette 10 is further inserted into the cassette mount 5 so that the threading shaft driving member 54 is moved downward, the member 54 is rotated counterclockwise in FIG. 13A by the distal cam portion 69*a* against the biasing force of the torsion coil spring 67. Since the driving force transmitting portion 54*a* departs from the horizontal face of the protruding plate 59, the driving force driving the threading shaft 50 downward is not transmitted to the threading slider 52. Accordingly, threading shaft 50 is rotated in the opposite direction and returned upward by the biasing force of the coil spring 58. With this, the hook mechanism 53 is also rotated in such a direction as to depart from the needle 15. Accordingly, the threading hook 60 which has caught the needle thread 11 is returned through the needle eye 15*a*, as shown in FIG. 14B, whereupon the threading operation is completed.

The thread carrying mechanism 17 will be described. Referring to FIGS. 3 and 15 to 17, the thread carrying mechanism 17 includes a holding member 70, an interlock transfer mechanism 73, a thread interposing member 74 and a torsion coil spring 75. The holding member 70 includes a pair of thread holding portions 71 and 72 capable of holding the needle thread 11 at predetermined intervals. The interlock transfer mechanism 73 transfers the thread holding portions 71 and 72 near the needle eye 15*a* in synchronization with attachment of the thread cassette 10. The thread interposing member 74 includes a left thread holding portion 71 for releasably interposing the needle thread 11. The torsion coil spring 75 elastically biases the thread interposing member 74 to the thread holding side. On the other hand, a cam member 42 is provided on the cassette body 30 of the thread cassette 10 for rocking the thread interposing member 74 temporarily to the releasing side in synchronization with a predetermined stage of a cassette attachment.

The thread carrying mechanism 17 includes a body frame 76 fixed to the head 4, a moving frame 77 which is guided and supported by the body frame so as to be moved upward and downward and to which the holding member 70 is fixed. The moving frame 77 is moved by the interlock transfer mechanism 73. The body frame 76 includes a needle thread take-up lever guiding member 78 located at both sides of the vertically rocking path of the needle thread take-up lever 13 and a pair of left and right guide plates 79*a* and 79*b* (see FIG. 3) provided on the right side of the guide member 78 and guiding the moving frame 77 vertically moved. The aforesaid guide member 27 guiding the thread cassette 10 in attachment of the cassette is formed integrally on a left portion of the left guide plate 79*a*. The moving frame 77 includes a pair of moving plates 80*a* and 80*b* provided between the guide plates 79*a* and 79*b* and connected to each other by a plurality of connecting pins.

The holding member 70 and the thread interposing member 74 will first be described. The thread holding portions 71 and 72 of the holding member 70 are connected to each other by a connecting member 81. The connecting member 81 has a right end extending horizontally rightward and is fixed via a holding member support 104 to a second wire 101 of the interlock transfer mechanism 73. The thread holding portions 71 and 72 are formed with recesses 71*a* and 72*a* for catching the needle thread 11 in attachment of the thread cassette 10 respectively. The thread interposing member 74 is pivotally mounted on a support shaft 82 further mounted on the left thread holding member 71. A torsion coil spring 75 is provided around the support shaft 82.

A recess 74*a* is formed in a front lower end of the thread interposing member 74. The recess 74*a* interposes the needle thread 11 in cooperation with the left thread holding portion 71. A driven pin 84 is provided on the lower end of the thread interposing member 74. The driven pin 84 is operated by a cam member 42 as will be described later. On the other hand, a limiting pin 85 is provided on the upper end of the thread interposing member 74. The upper end of the member 74 is opposed to the driven pin 84 relative to the support shaft 82. The limiting pin 85 prevents the thread interposing member 74 from rocking to the thread interposing side over a predetermined range. The driven pin 84 projects leftward, whereas the limiting pin 85 projects rightward.

Figures 16A, 16B, 16C:
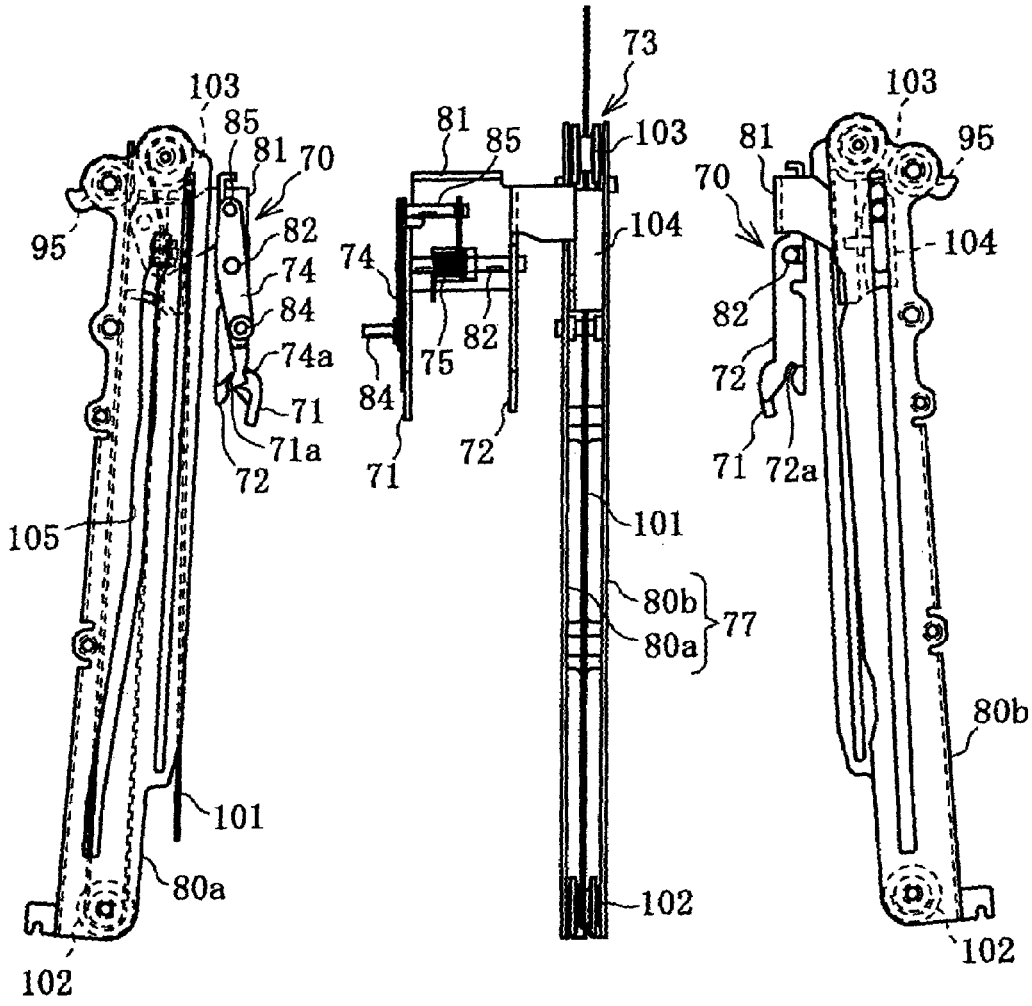
FIGS. 16A, 16B and 16C are left side, front and right side views of a holding member and moving frame, respectively.
Figure 17:
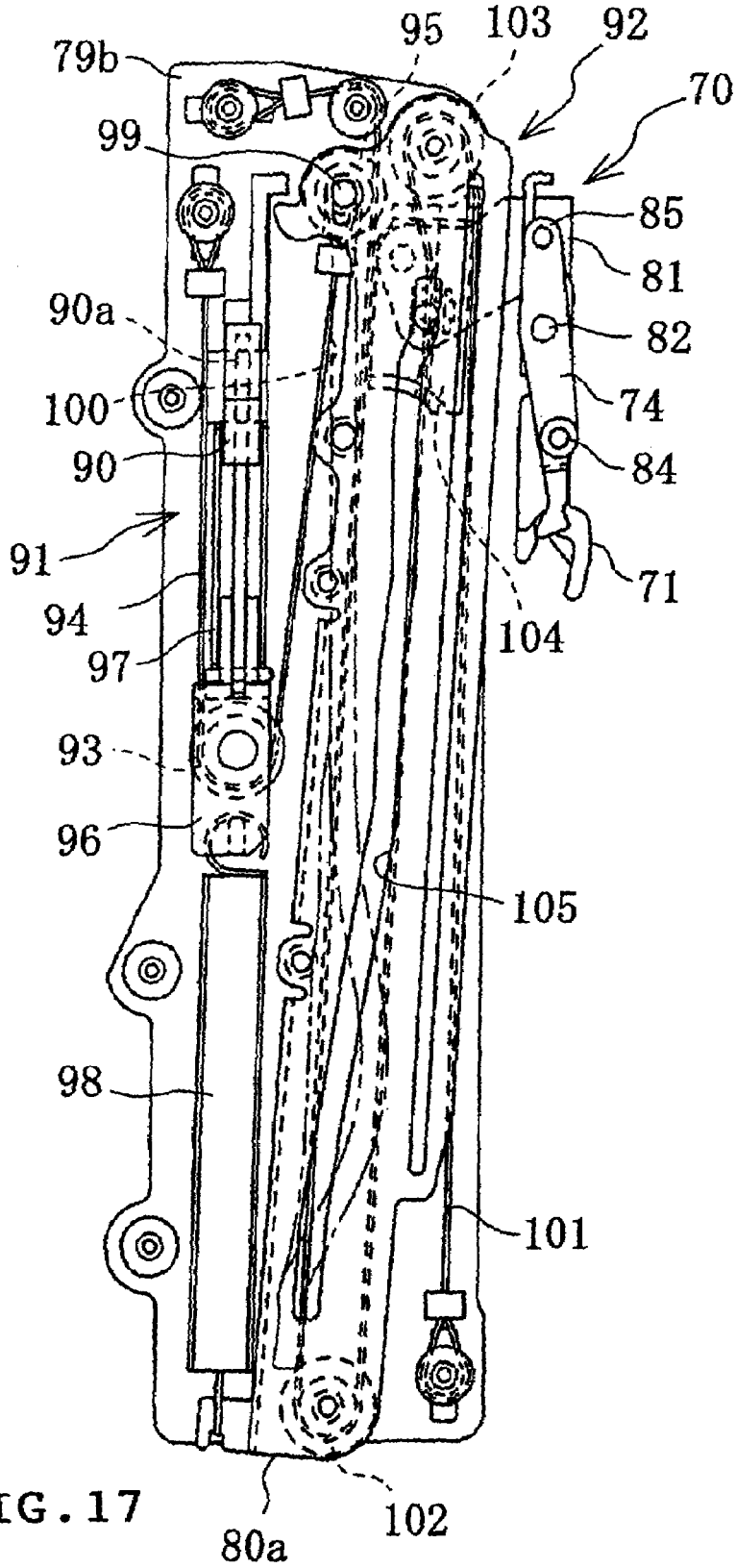
FIG. 17 is a left side view of the holding member and interlock moving mechanism.

The interlock transfer mechanism 73 will be described. Referring to FIGS. 16A to 17, the interlock transfer mechanism 73 includes a cassette contact 90 made of a synthetic resin and first and second running block mechanisms 91 and 92. The cassette contact 90 comes into contact with the thread cassette 10 during attachment of the cassette thereby to be pressed downward. The running block mechanisms 91 and 92 are constructed to move the holding member 70 by an amount of movement four times larger than the movement amount of the cassette contact 90. The cassette contact 90 is vertically moved between the paired guide plates 79*a* and 79*b* of the body frame 76. The cassette contact 90 includes a contact portion 90*a* formed on a left end thereof so as to project leftward from left guide plate 79*a*.

The first running block mechanism 91 includes a pulley 93 which is coupled to the cassette contact 90 so as to be vertically moved with the contact, a first wire 94 wound on the pulley 93 and having an end fixed to the guide plate 79*b*, and a pulley 95 coupled to the other end of the first wire 94. The pulley 93 is enclosed in a pulley accommodating member 96 made of a syntheic resin. The pulley accommodating member 96 is vertically moved with the pulley 93 between the guide plates 79*a* and 79*b* below the cassette contact. A coil spring 97 is provided between the cassette contact 90 and the pulley accommodating member 96 for biasing the cassette contact upward relative to the pulley 93. On the other hand, the pulley 93 and the pulley accommodating member 96 are biased upward by a coil spring 98 provided for returning the moving frame 77 upward. The coil spring 98 has a lower end connected to the lower end of the left moving plate 80*a*.

The first wire 94 has one end fixed to a portion of the guide plate 79*b* located above the cassette contact 90 and the other end fixed to a pin member 99 connecting upper ends of the paired moving plates 80*a* and 80*b*. The pin member 99 is supported on the guide plates 79*a* and 79*b* so as to be vertically moved along the guide groove 100. The pulley 95 is rotatably mounted on the pin member 99. Accordingly, the pulley 95 and moving plates 80*a* and 80*b* are vertically moved relative to the guide plates 79*a* and 79*b* (body frame 76) while the pin member 99 is guided by the guide groove 100.

When the cassette contact 90 is brought into contact with the thread cassette 10 during cassette attachment thereby to be pushed downward, the pulley 93 is also pushed downward with the cassette contact 90. In this case, since the pulley 93 serves as a running block, the pulley 95 and moving frame 77 are moved downward by an amount twice as large as the movement amount of the cassette contact 90.

The second running block mechanism 92 includes a second wire 101 having both ends fixed to the guide plate 79*b* and two pulleys 102 and 103 on which the second wire 101 is wound. The pulleys 102 and 103 are rotatably supported on the lower and upper ends of the moving plates 80*a* and 80*b* respectively. The second wire 101 has one end fixed to the upper end of the guide plate 79*b* and the other end fixed to the lower end of the guide plate 79*b* while the second wire 101 is wound on the pulleys 102 and 103.

Referring to FIG. 17, a holding member support 104 made of a synthetic resin is fixed to a portion of the second wire 101 between the pulleys 102 and 103. The connecting member 81 of the holding member 70 is connected to the holding member support 104. The holding member support 104 and connecting member 81 are supported between the paired moving plates 80*a* and 80*b* so as to be vertically moved along the guide groove 105.

When the moving plates 80*a* and 80*b* are moved downward by the first running block mechanism 91, the two pulleys 102 and 103 are also moved downward with movement of the plates 80*a* and 80*b*. In this case, the pulley 102 acts as a running block. Accordingly, when a portion of the second wire 101 wound on the pulley 102 is pushed downward by the pulley, the second wire 101 is moved downward (leftward as viewed in FIG. 17) from the front (right side as viewed in FIG. 17) of the pulley 102 by an amount twice as large as movement amount of the pulley 102. That is, the holding member 70 connected to the portion of the second wire 101 between the pulleys 102 and 103 is also moved downward and thus, a movement amount of the holding member 70 is four times larger than that of the thread cassette 10.

The cam member 42 will now be described. The cam member 42 is formed integrally on the front of the cassette body 30 so as to project forward as shown in FIGS. 4, 6, 7 and 15. The cam member 42 includes a projecting portion 110 projecting forward from the front of the cassette body 30 and a cam formed portion 111 extending rightward from a front end of the projecting portion 110.

A pin passage 112 is defined between the cam formed portion 111 and the front of the thread cassette 10. The driven pin 84 passes through the pin passage 112 relative to the thread cassette 10 during attachment of the cassette. A cam face 111*a* is formed on the rear of the cam formed portion 111. The driven pin 84 moves or slides along the cam face 111*a* during the cassette attachment. The cam face 111*a* includes an upper inclined face expanding rearward as it goes downward and a lower inclined face continuous to a lower end of the upper inclined face and expanding frontward as it goes downward. More specifically, the cam face 111*a* confronting the front of the thread cassette 10 is formed so as to project rearward. A boundary between the upper and lower inclined faces is bent and the cam face 111*a* projects rearmost at the bent portion. Accordingly, the driven pin 84 passes through the pin passage 112 along the cam face 111*a* as the thread cassette 10 is moved downward. The driven pin 84 is thus operated by the cam member 42 so that the thread interposing member 74 is rocked back and forth. At this time, the needle thread 11 is interposed between the thread holding portion 71 and the thread interposing member 74.

Figure 18:
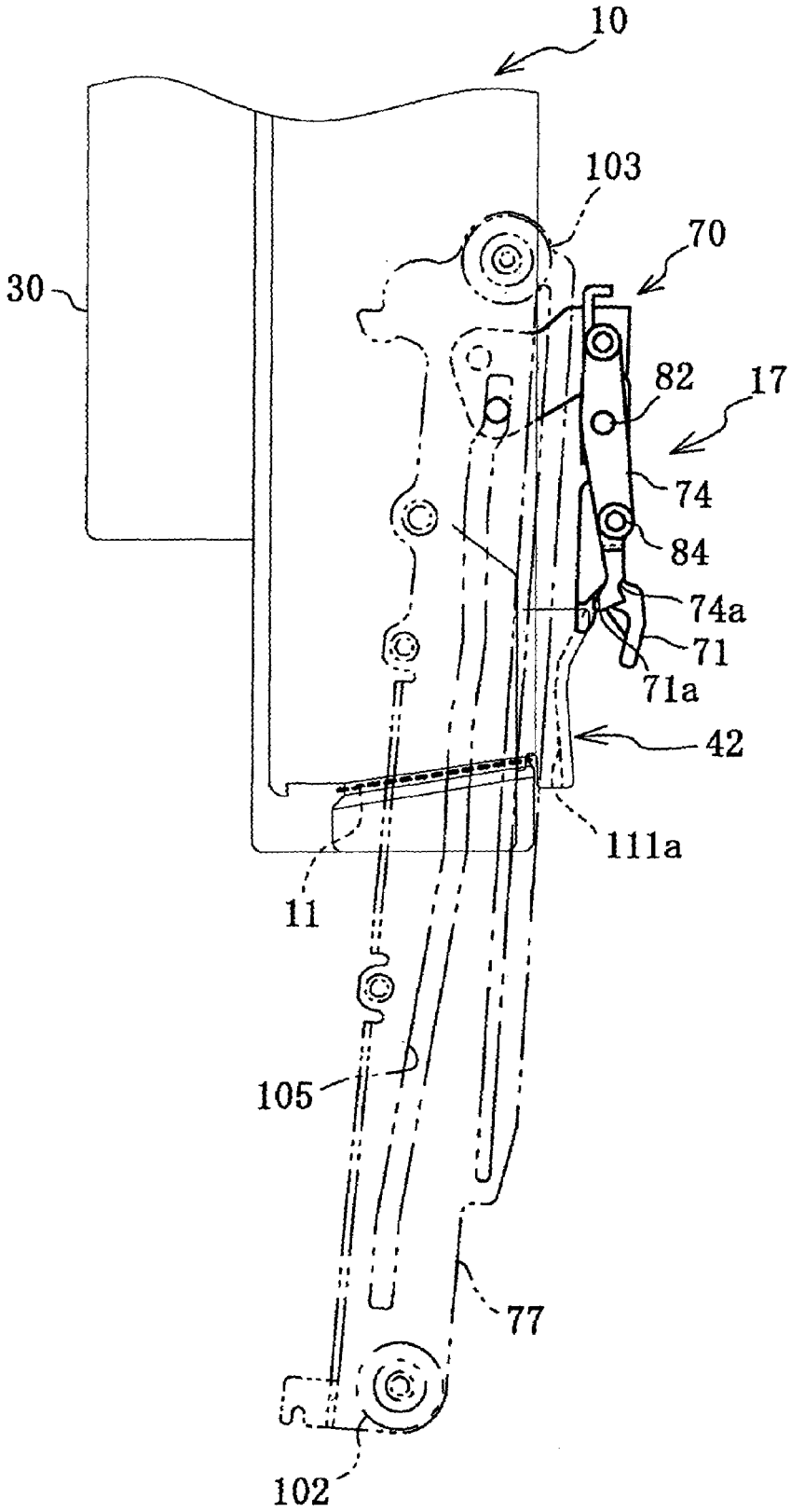
FIG. 18 illustrates the holding member and thread holding member immediately before movement of the holding member.
Figure 19:
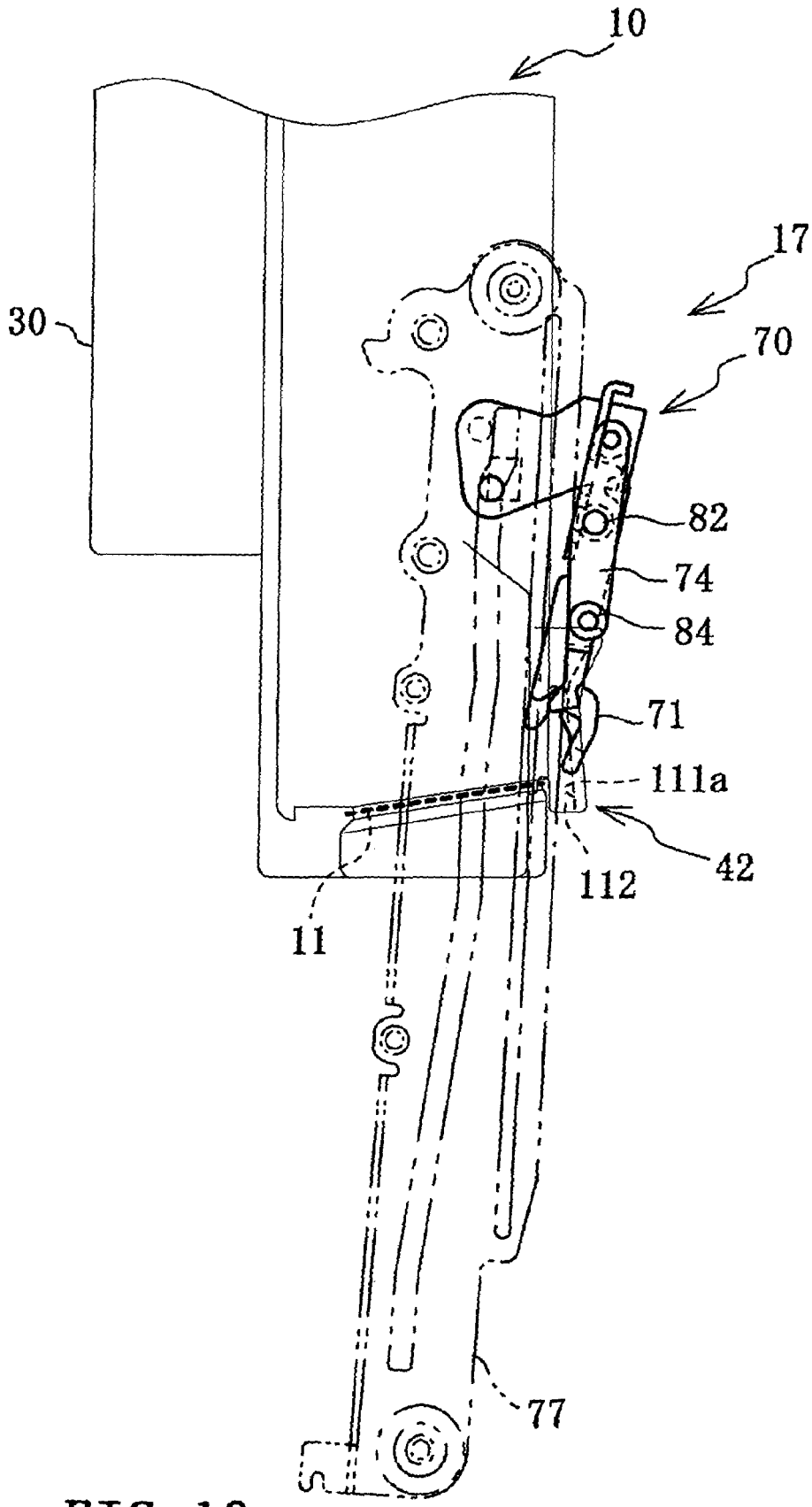
FIG. 19 illustrates the holding member and thread holding member upon start of the rocking motion of the thread holding member.

The thread carrying operation of the thread carrying mechanism 17 will now be described with special attention to the foregoing thread interposing operation between the thread holding portion 71 and the thread interposing member 74, with reference to FIGS. 15 and 18 to 25. FIG. 18 shows the condition immediately after the thread cassette 10 has come into contact with the cassette contact 90. In this condition, the thread interposing member 74 is biased to the thread interposing side by the torsion coil spring 75. When the thread cassette 10 is further thrust into the cassette mount 5 in this condition, the operating force is transmitted from the thread cassette 10 to the cassette contact 90, so that the contact is moved downward, as shown in FIG. 19. The holding member 70 is moved downward in synchronization with the movement of the cassette contact 90. In this case, a movement amount of the holding member 70 is rendered four times larger than that of the thread cassette 10 by the first and second running block mechanisms 91 and 92 in FIG. 17.

Figure 20:
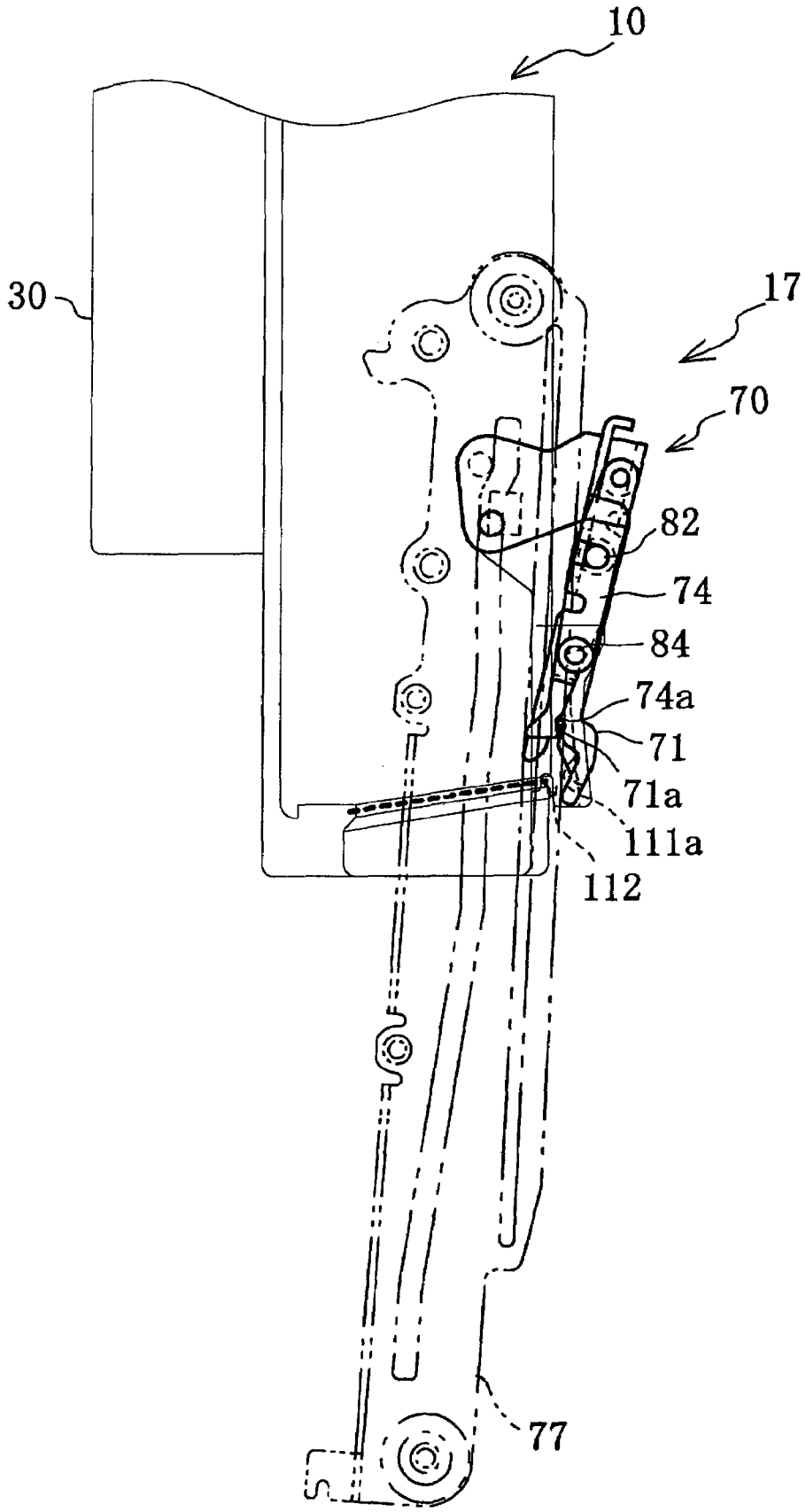
FIG. 20 illustrates the holding member and thread holding member in a case where the holding member has started rocking.
Figure 21:
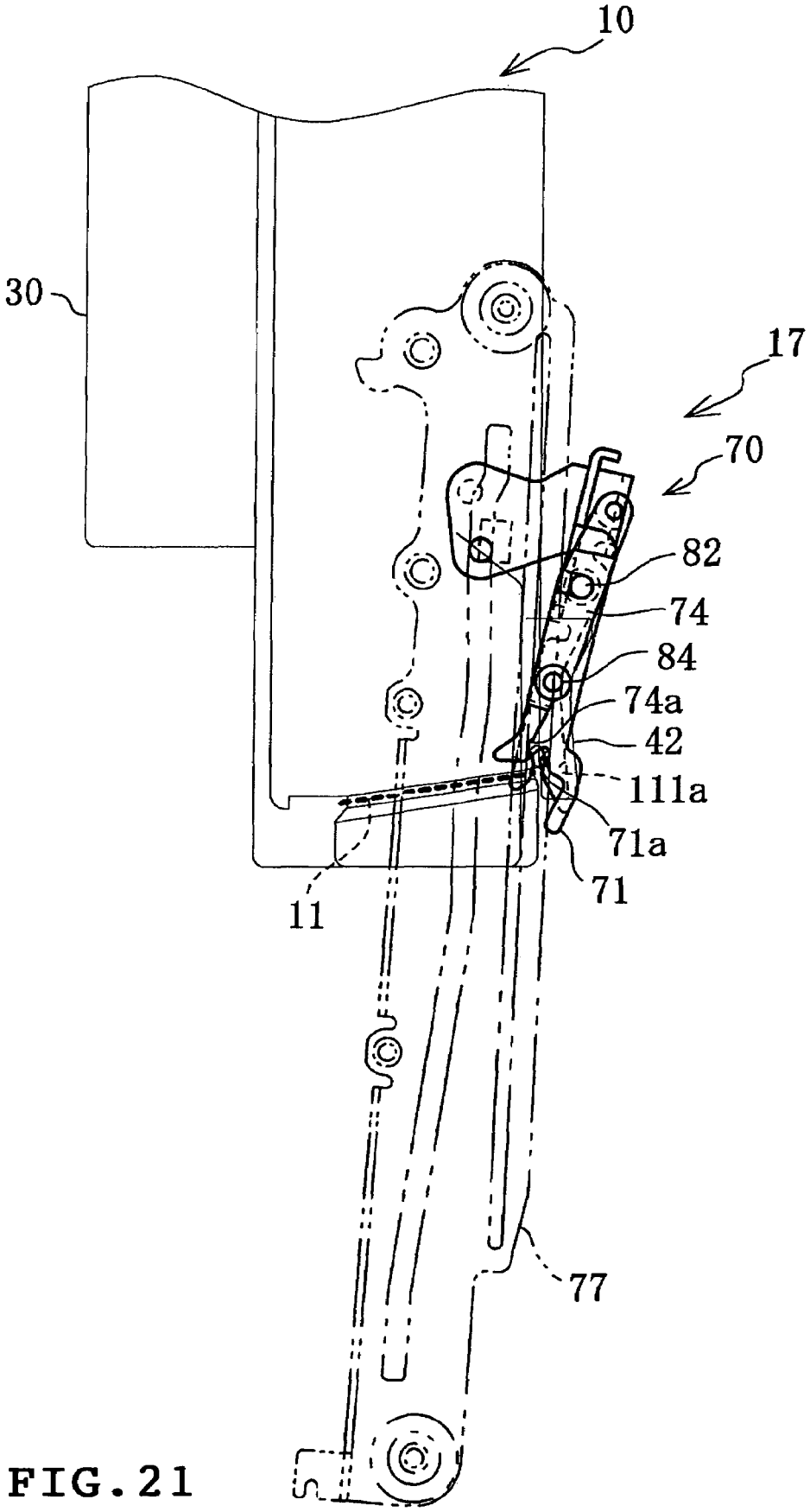
FIG. 21 illustrates the holding member and thread holding member in a case where the rocking has been maximized.
Figure 22:
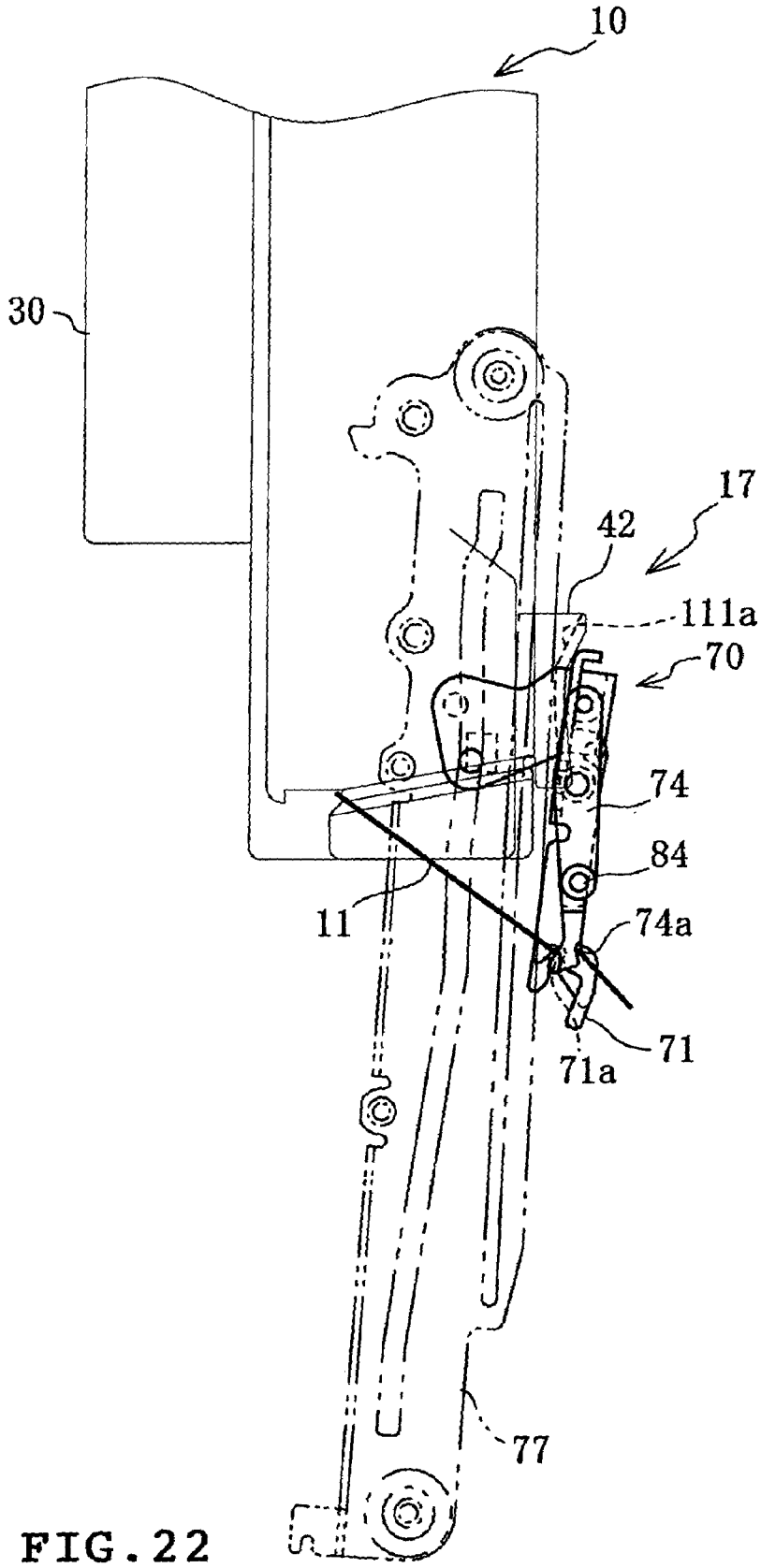
FIG. 22 illustrates the holding member and thread holding member in a case where the rocking has been completed.

When then reaching the pin passage 112 formed inside the cam member 42, the driven pin 84 is pressed rearward by the cam face 111*a*, as shown in FIG. 20. With this, the thread interposing member 74 is rocked about the pivot shaft 82 to the interposition releasing side. Furthermore, when the holding member 70 is moved downward and the thread interposing member 74 is rocked to the interposition releasing side at its maximum when the driven pin 84 reaches the rearmost projecting portion of the cam face 111*a* as shown in FIG. 21. At this time, a part 11*c* (see FIGS. 4 and 7) of the needle thread 11 extending along the front of the thread cassette 10 enters a space between the recess 71*a* of the thread holding portion 71 and the recess 74*a* of the thread interposing member 74. When the driven pin 84 is further moved downward along the cam face 111*a* and passes through a maximum projected portion of the cam face 111*a* in the pin passage 112, the thread interposing member 74 is biased by the torsion coil spring 75 (see FIG. 16B) thereby to be rocked to the thread interposing side. When the driven pin 84 passes through the pin passages 112 thereby stop contacting the cam face 111*a*, the needle thread 11 is interposed between the recess 71*a* of the thread holding portion 71 and the recess 74*a* of the thread interposing portion 74. The limiting pin 85 is spaced away upward from the recess 71*a* and the thread interposing portion 74*a*.

Figure 23:
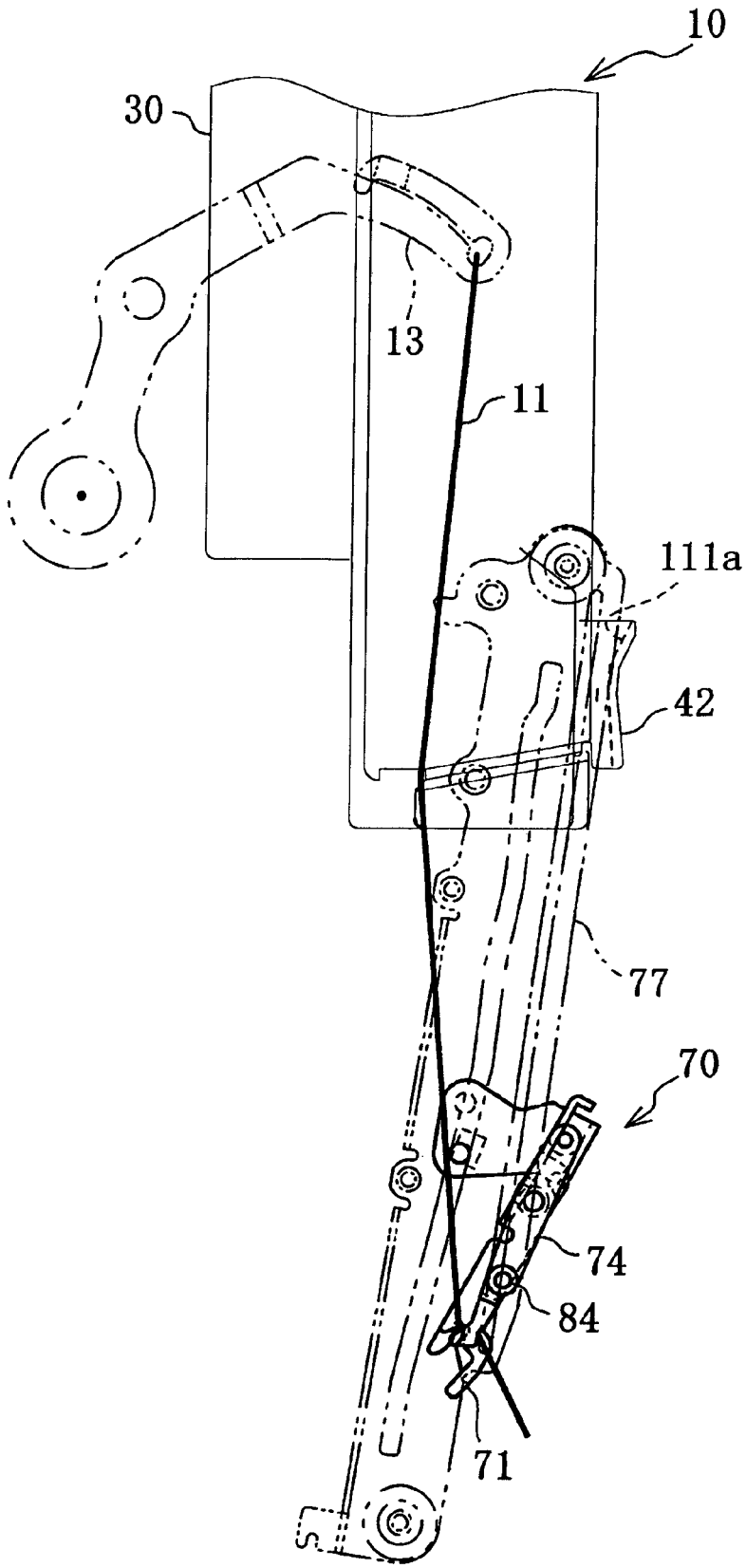
FIG. 23 illustrates the holding member and thread holding member in a case where the needle thread has been held.
Figure 24:
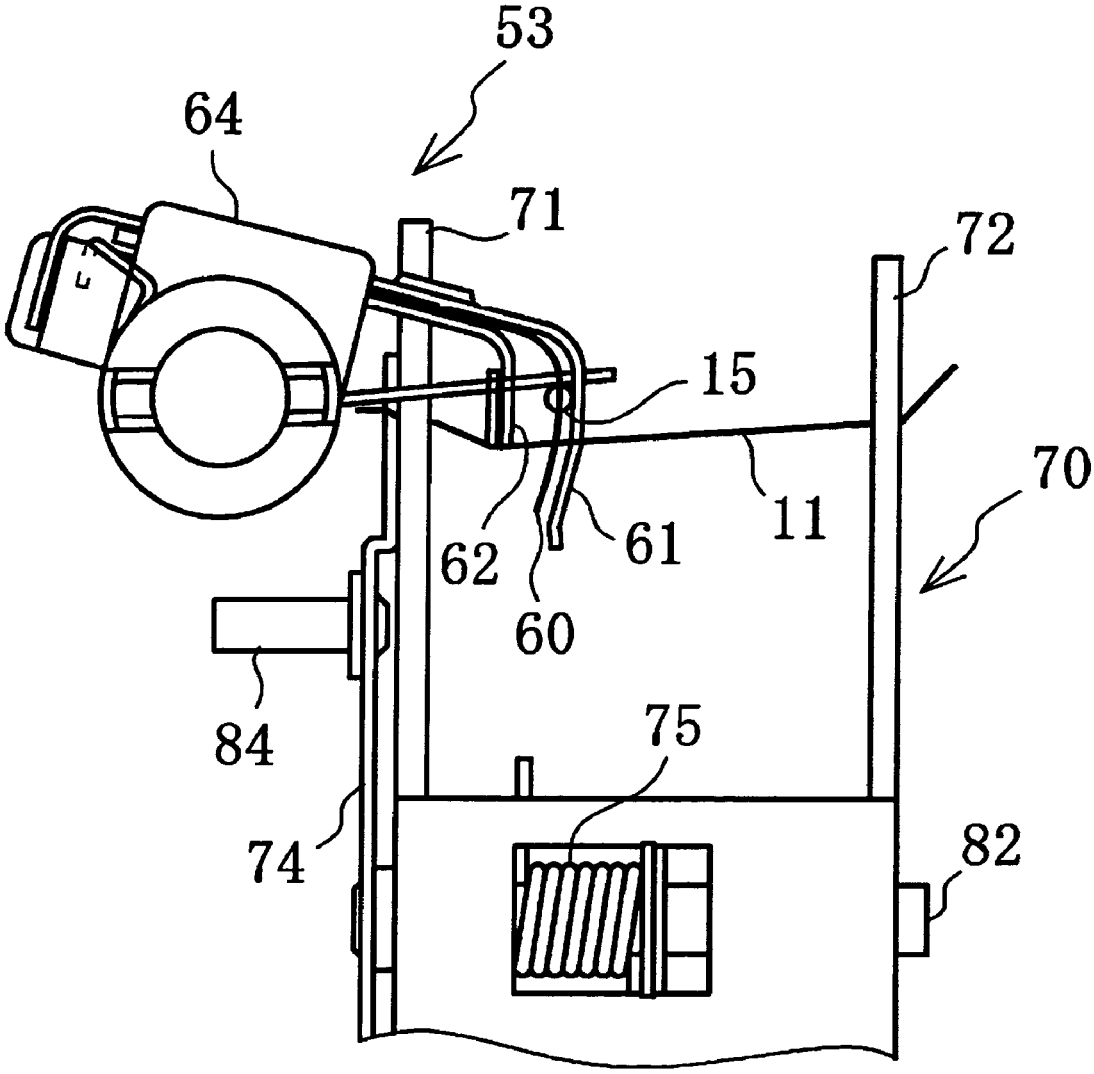
FIG. 24 is a partially plan view of the hook mechanism and holding member during threading.

The moving frame 77 is further moved downward while the needle thread 11 is interposed, as shown in FIG. 23. As a result, the needle thread 11 is held near the needle eye 15*a* by the thread holding portions 71 and 72. At this time, as shown in FIG. 24, a hook mechanism 53 of the threading mechanism 16 is rotated clockwise so that the threading hook 60 passes through the needle eye 15*a*.

Figure 25:
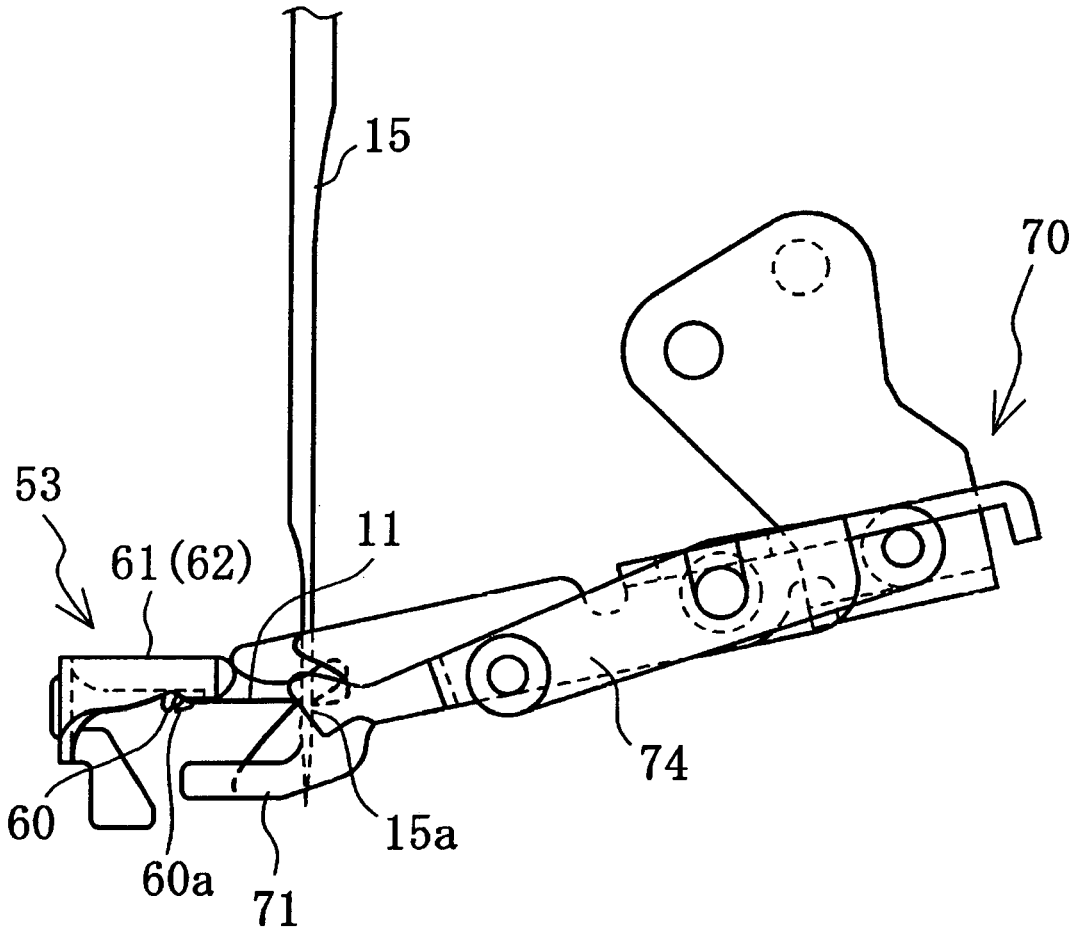
FIG. 25 is a left side view of the holding member and thread holding member during threading.

The cassette contact 90 depressed in contact with the lower end of the thread cassette 10 is departed from the cassette when the holding member 70 has been moved near the needle eye 15*a*. As a result, the pulley 93 is moved upward by the biasing force of the returning coil spring 98. With this, the moving frame 77 and the holding member 70 are moved upward. The needle thread 11 held by the thread holding portions 71 and 72 is then caught by the threading hook 60. In this state, the hook mechanism 53 is returned counterclockwise in FIG. 24, whereupon the needle thread 11 is passed through the needle eye 15*a* as shown in FIGS. 25 and 26.

The sequential operation of the sewing machine M in attachment of the thread cassette 10 will now be described with special attention to the moving speed limiting mechanism 21. When the user inserts and thrusts the thread cassette 10 into the cassette mount 5 from above, the thread cassette is attached to the cassette mount 5 with the downwardly moving speed of the cassette being limited. More specifically, when the thread cassette 10 is moved downward under the condition where a pinion holder plate 124 stands upright by a biasing force of a leaf spring 125 as shown in FIG. 11A, the inclined guide portion 126*b* is also moved downward as shown in FIG. 11B. The inclined guide portion 126*b* is slid against the driven pin 124*a*, so that the driven pin is rocked rearward. As a result, the pinion holder plate 124 is rocked rearward against the biasing force of the leaf spring 125 such that the pinion 121 is switched to the meshing position where the pinion meshes the rack 120.

When the user further inserts the thread cassette 10 into the cassette mount 5 while the pinion 121 is in mesh engagement with the rack 120, a horizontal guide portion 126*a* is slid against the driven pin 124*a*, thereby guiding the rack 120 being moved downward. Since the pinion 121 is in mesh engagement with the rack 120, the pinion is rotated by the movement of the rack 120. However, since rotational resistance is applied to the pinion 121 by the rotational resistance applying member 122, resistance preventing the attaching operation acts on the thread cassette 10. Accordingly, even when the downwardly moving speed of the thread cassette 10 is excessively high, such as when the thread cassette is thrust into the cassette mount 5 at a stroke, the downwardly moving speed of the thread cassette is limited by the rotational resistance applying member 122.

When the driven pin 124*a* relatively reaches the upper end of the switching and guiding member 126, the driven pin 124*a* is disengaged from the switching and guiding member, as shown in FIG. 11E. The driven pin 124*a* is then rocked forward by the biasing force of the leaf spring 125 to be once received by the receiving portion 120*a*. Consequently, the pinion holder plate 124 is slightly rocked forward to stand upright, whereupon the pinion 121 is switched to the retreat position where the pinion is prevented from mesh engagement with the rack 120.

Thus, since the downwardly moving speed of the thread cassette 10 is limited by the moving speed limiting mechanism 21, shock caused in the thread cassette or sewing machine body M1 can be reduced in attachment of the thread cassette.

Furthermore, the operating force for operating threading mechanism 16 and the thread carrying mechanism 17 is transmitted to the threading operating member 66 and the cassette contact 90 when the threading operating member and the cassette contact are pressed by the thread cassette 10. Downwardly moving speeds of the threading operating member 66 and the cassette contact 90 are also limited in the same manner as described above. Accordingly, a suitable operating force is applied to each of the threading mechanism 16 and thread carrying mechanism 17, whereupon these mechanisms are operated at respective suitable operating speeds. Consequently, the threading operation and the thread carrying operation can be carried out reliably by the threading mechanism 16 and the thread carrying mechanism 17 respectively.

The pinion 121 is automatically switched from the meshing position to the retreat position by the switching mechanism 123 in the attachment of the thread cassette 10. Accordingly, the pinion 121 is spaced from the rack 120 when the thread cassette 10 is disengaged from the cassette mount 5. Resistance preventing detachment does not act on the thread cassette 10 as shown in FIGS. 12A to 12E, and the thread cassette can be detached from the cassette mount 5.

The following effects can be achieved from the foregoing sewing machine M. Since the downwardly moving speed of the thread cassette 10 is limited by the moving speed, the downwardly moving speed of the thread cassette is limited by the rotational resistance applying member 122 even when the downwardly moving speed of the thread cassette 10 is excessively high, such as when the thread cassette is thrust into the cassette mount 5 at a stroke. Consequently, shock caused in the thread cassette 10 or sewing machine body M1 can be reduced in attachment of the thread cassette. Accordingly, the thread cassette 10 can be prevented from being damaged and the cassette mount 5 can be prevented from being broken. Furthermore, any equipment provided in the sewing machine for sewing and sewing preparation can also be prevented from being broken.

The operating force is transmitted from the thread cassette 10 to the threading operation member 16 and the cassette contact 90. More specifically, the operating force is transmitted from the threading mechanism 16 and the thread carrying mechanism 17 to the threading member 66 and the cassette contact 90. Since the moving speed of the thread cassette 10 is limited by the moving speed limiting mechanism 21, the downwardly moving speeds of the threading operation member 66 and cassette contact 90 are also limited. Consequently, the threading mechanism 16 and the thread carrying mechanism 17 can be operated at suitable speeds respectively, and accordingly, the threading operation and the thread carrying operation can be carried out reliably.

When the thread cassette 10 is attached to the cassette mount 5, the switching mechanism 123 switches the pinion 121 to the meshing position where the pinion meshes the rack 120. Consequently, the moving speed of the thread cassette 10 can be limited reliably in the attachment to the cassette mount 5. Furthermore, when the thread cassette 10 is detached from the cassette mount 5, the switching mechanism 123 switches the pinion 121 to the retreat position where the pinion is prevented from mesh engagement with the rack 120. Consequently, the thread cassette 10 can be detached from the cassette mount 5 smoothly since no resistance preventing detachment is applied to the thread cassette.

The driven pin 124*a* is reliably abutted against the rear of the inclined guide portion 126*b* by the elastic biasing force of the leaf spring 125 during attachment of the thread cassette 10. Consequently, since mesh engagement is reliably maintained between the pinion 121 and rack 120, the downwardly moving speed of the thread cassette 10 can reliably be limited.

Modified forms of the foregoing embodiment will now be described. The present invention may be applied to sewing machines constructed so that an operating force for operating the threading mechanism 16 or the thread carrying mechanism 16 is supplied by a manually operated operating lever. In this case, even when the operating lever is thrust at a stroke, the downwardly moving speed of the operating force transmitting member can be limited.

The invention may also be applied to sewing machines provided with no threading mechanism 16 and no thread carrying mechanism 17. In this case, even when the thread cassette 10 is thrust at a stroke, shock resulting from attachment of the thread cassette is reduced by limiting the downwardly moving speed of the thread cassette by the moving speed limiting mechanism 21. Consequently, components mounted around the cassette mount 5 can be prevented from being broken.

In the foregoing embodiment, the moving speed limiting mechanism 21 applies rotational resistance to the pinion 121 meshing the rack 120 thereby to limit the moving speed of the thread cassette 10 rubber or the like may be brought into direct contact with the thread cassette 10 so that frictional resistance is applied to the thread cassette, instead. Furthermore, a biasing member such as a coil spring may be provided for biasing the thread cassette 10 upward.

The liquid of the rotational resistance applying unit may be another liquid having a relatively higher viscosity, instead of grease. A suitable fluid or a gas may be employed instead of the liquid. When a gas is employed, an air damper or the like may be used as the rotational resistance applying unit.

The supply of thread accommodated in the thread cassette may be a thread spool, bobbin or mere lamp of thread, instead, and thus, various types of thread supply may be used. Furthermore, the thread spool or lamp of thread may merely be mounted on a spool pin while being exposed.

In the foregoing embodiment, the user thrusts the thread cassette 10 into the cassette mount 5. Another driving means such as rubber rollers or an electric motor may be provided for automatically attaching the thread cassette. Furthermore, the driving means may be used to drive the thread carrying mechanism 17 or the threading mechanism 18.

Furthermore, the pinion 121 is directly connected to the rotational resistance applying unit 122 in the foregoing embodiment. The pinion 121 may be connected via a reduction mechanism for reducing a rotational speed of the pinion 121 to the rotational resistance applying unit 122, instead. In this case, even when the rotational speed of the pinion 121 exceeds a limit value applying a predetermined resistance, the predetermined rotational resistance can be applied to the pinion 121 by the rotational resistance applying unit 122 since the rotational speed of the pinion 121 is reduced by the reduction mechanism.

The moving speed limiting mechanism 21 limits the moving speeds of the threading operation member 66 and cassette contact 90 so that the moving speeds do not exceed predetermined values at which the threading mechanism 16 and the thread carrying mechanism 17 can be operated stably. The moving speed limiting mechanism 21 may be constructed so that a speed of the operating force applying member is not reduced to or below a predetermined speed, instead. In this case, a predetermined speed of the operating force transmitting member can be maintained while an attaching efficiency of the thread cassette 10 can be improved.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing machine comprising:

a sewing machine body provided with a cassette mount;

a thread cassette having a supply of thread and detachably attached to the cassette mount; and a moving speed limiting unit limiting a moving speed of the thread cassette when the thread cassette is attached to the cassette mount, the moving speed limiting unit including a moving member capable of moving substantially together with the thread cassette in a course of movement of the thread cassette to a predetermined position in the cassette mount, a rotating member rotated by movement of the moving member, and a rotational resistance applying unit applying rotational resistance to the rotating member.

2. A sewing machine according to claim 1, wherein the moving member is a rack which is provided on the thread cassette so as to extend in a predetermined direction, and the rotating member is a pinion which is provided on the sewing machine body so as to mesh the rack.

3. A sewing machine according to claim 2, wherein the pinion is displaced between a meshing position where the pinion meshes the rack and a retreat position where the pinion is disengaged from the rack, and the moving speed limiting unit includes a switching mechanism switching the pinion to the meshing position when the thread cassette is attached to the cassette mount and to the retreat position when the thread cassette is detached from the cassette mount.

4. A sewing machine according to claim 3, wherein the switching mechanism includes a biasing member biasing the pinion to the retreat position, a switching guide member provided on the thread cassette to switch the pinion from the retreat position to the meshing position against a biasing force of the biasing member when the thread cassette is attached to the cassette mount and further to guide the rack.

5. A sewing machine according to claim 1, further comprising a threading mechanism passing a thread through an eye of a sewing needle and an operating force transmitting member moved when an operating force is transmitted thereto from the thread cassette under movement, thereby operating the threading mechanism by movement thereof.

6. A sewing machine according to claim 1, further comprising:

a thread carrying mechanism carrying a thread in order that the thread may be passed through the needle eye; and an operating force transmitting member moved when an operating force is transmitted thereto from the thread cassette under movement, thereby operating the thread carrying mechanism by movement thereof.

7. A thread cassette comprising:

a cassette body having a supply of thread and detachably attached to a cassette mount provided in a sewing machine; and a moving speed limiting unit limiting a moving speed of the thread cassette when the thread cassette is attached to the cassette mount, the moving speed limiting unit including a moving member capable of moving substantially together with the thread cassette in a course of movement of the thread cassette to a predetermined position in the cassette mount, a rotating member rotated by movement of the moving member, and a rotational resistance applying unit applying rotational resistance to the rotating member.

8. A thread cassette according to claim 7, wherein the moving member is a rack which is provided on the thread cassette to as to extend in a predetermined direction, and the rotating member is a pinion provided on a sewing machine body so as to mesh the rack, the thread cassette further comprising a switching mechanism switching the pinion so that the pinion meshes the rack and the rack is guided when the thread cassette is attached to the cassette mount and so that the pinion is prevented from meshing the rack when the thread cassette is detached from the cassette mount.

9. A thread cassette according to claim 8, wherein the rotational resistance applying unit uses a liquid to apply the rotational resistance.

10. A thread cassette according to claim 8, wherein the rotational resistance applying unit uses a gas to apply the rotational resistance.

* * * * *